US008153257B2

(12) United States Patent
Mizrahi et al.

(10) Patent No.: US 8,153,257 B2
(45) **Date of Patent: *Apr. 10, 2012**

(54) CAPPED PARTICLES COMPRISING MULTI-BLOCK COPOLYMERS FOR USE IN LUBRICANTS

(75) Inventors: Shimon Mizrahi, Haifa (IL); Terry M Finerman, Rochester, MI (US)

(73) Assignee: Productive Research LLC, West Bloomfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/983,449

(22) Filed: Jan. 3, 2011

(65) Prior Publication Data

US 2011/0166051 A1 Jul. 7, 2011

Related U.S. Application Data

(60) Provisional application No. 61/292,510, filed on Jan. 6, 2010.

(51) Int. Cl.
*B32B 5/16* (2006.01)
*B05D 7/00* (2006.01)
*C07F 7/00* (2006.01)

(52) U.S. Cl. ..... 428/407; 427/214; 427/215; 427/216; 427/221; 508/382; 508/591

(58) Field of Classification Search ..... 428/407; 427/215, 216, 221; 508/382, 591
See application file for complete search history.

(56) References Cited

U.S. PATENT DOCUMENTS

| | | | | |
|---|---|---|---|---|
| 4,995,996 | A | 2/1991 | Coyle et al. | |
| 6,007,845 | A | 12/1999 | Domb et al. | |
| 6,599,631 | B2 * | 7/2003 | Kambe et al. | 428/447 |
| 6,613,721 | B1 * | 9/2003 | Kernizan et al. | 508/103 |
| 6,627,314 | B2 | 9/2003 | Matyjaszewski et al. | |
| 6,860,918 | B2 * | 3/2005 | Ozaki et al. | 75/252 |
| 6,878,676 | B1 | 4/2005 | Migdal et al. | |
| 6,991,741 | B2 | 1/2006 | Bullock et al. | |
| 7,217,683 | B1 | 5/2007 | Blanski et al. | |
| 7,291,287 | B2 | 11/2007 | Mikhalev et al. | |
| 7,875,112 | B2 * | 1/2011 | Huber et al. | 106/415 |
| 2003/0132121 | A1 | 7/2003 | Breen et al. | |
| 2007/0004602 | A1 | 1/2007 | Waynick | |
| 2008/0139399 | A1 * | 6/2008 | Fonnum et al. | 506/9 |
| 2010/0004147 | A1 * | 1/2010 | Mizrahi | 508/103 |

FOREIGN PATENT DOCUMENTS

| | | | |
|---|---|---|---|
| WO | 01/94504 | A2 | 12/2001 |
| WO | 2006/061835 | A1 | 6/2006 |
| WO | 2006/065695 | A2 | 6/2006 |
| WO | 2006/119502 | A2 | 11/2006 |

(Continued)

OTHER PUBLICATIONS

Saleh et al, Adsorbed Triblock Copolymers Deliver Reactive Iron Nanoparticles to the Oil/Water Interface, Nano Letters (2005), vol. 5, No. 12, 2489-2494.*

(Continued)

*Primary Examiner* — Hoa (Holly) Le

(57) ABSTRACT

The present invention relates to capped particle additives for use in lubricant compositions, to processes for producing the additives, and to the use of the additives in lubricants and in systems that are lubricated. When used in a lubricant to lubricate a metallic surface of a workpiece, the capped particle preferably adhere to the metallic surface of the workpiece.

20 Claims, 10 Drawing Sheets

FOREIGN PATENT DOCUMENTS

| | | | |
|---|---|---|---|
| WO | 2007/068102 | A2 | 6/2007 |
| WO | 2007/082299 | A2 | 7/2007 |

OTHER PUBLICATIONS

Chen et al., "Suspension Polymerization Stabilized by Triblock Copolymer with CdS Nanoparticles," Polymer (2008) 49:2650-2655.*

Ahmed, et al., "Synthesis and Magnetic Properties of Block Copolymer—$CoFe_2O_4$ Nanoclusters," Materials Research Society Symposium Proceedings (2001) 661:KK10.10.1-KK10.10.6, Materials Research Society.

Ahmed, "Magnetic Properties and Morphology of Block Copolymer-Cobalt Oxide Nanocomposites," Journal of Magnetism and Magnetic Materials 288 (2005) 219-223, Elsevier B.V.

Bakunin, et al., "Synthesis and Application of Inorganic Nanoparticles as Lubricant Components—a Review," Journal of Nanoparticle Research (2004) 6:273-284, Kluwer Academic Publishers.

Bakunin, et al., "Recent Achievements in the Synthesis and Application of Inorganic Nanoparticles as Lubricant Components," Lubrication Science (Feb. 2005) 17: I27-145, ISSN 0954-0075.

Chen, et al., "Suspension Polymerization Stabilized by Triblock Copolymer With CdS Nanoparticles," Polymer (2008) 49:2650-2655, Elsevier.

Fan, et al., "Reduction of Friction by Functinalised Viscosity index Improvers," Tribol Lett (2007) 28:287-298, Springer Science+Business Media, LLC.

Glovnea, et al., "Lubrication of Rough Surfaces by a Boundary Film-Forming Viscosity Modifier Additive," Journal of Tribology (2005) 127:223-229, ASME.

Hsu, et al., "Boundary, Lubricating Films: Formation and Lubrication Mechanism," Tribology International (2005) 38:305-312, Elsevier B.V.

Kedzierski, "Effect of CuO Nanoparticle Concentration on R134a/Lubricant Pool Boiling Heat Transfer with Extensive Analysis," National institute of Standards and Technology (2007) NISTIR 7450:1-33, U.S. Department of Commerce.

Liou, et al., "Synthesis of a Star-Shaped Poly(Ethylene-co-Propylene) Copolymer as a Viscosity Index Improver for Lubricants," Journal of Applied Polymer Science (2002) 83:1911-1918, John Wiley & Sons, Inc.

Pitkethly, Nanoparticles as Building Blocks? Nanotoday, (2003) 36-42, Elsevier Ltd.

PCT/US2009/048766, PCT International Search Report and PCT Written Opinion (2009).

* cited by examiner

CAPPED PARTICLES COMPRISING MULTI-BLOCK COPOLYMERS FOR USE IN LUBRICANTS

CLAIM OF BENEFIT OF FILING DATE

The present application claims the benefit of the filing date of U.S. Provisional Patent Application No. 61/292,510 (filed on Jan. 6, 2010), the contents of which is incorporated herein by reference in its entirety.

FIELD OF THE INVENTION

The present invention relates to ingredients for lubricant compositions, such as capped particles containing a multi-block copolymer, having at least three polymeric blocks, attached to a particle, processes for preparing the same, and to lubricant compositions including capped particles.

BACKGROUND

Polymeric additives such as viscosity index improvers are currently used in many applications such as multigrade engine oils and many transmission and hydraulic oils. These polymeric additives may function to modify the bulk rheological properties of the lubricant fluids. It is believed that some of these additives adsorb onto lubricated metallic surfaces, form films, and reduce friction between two contacting parts in moving relation to one another. The adsorbed layers may maintain a hydrodynamic film, and thereby correspondingly lower friction. Such a film may be present even at low entrainment speeds at which hydrodynamic films may not be expected based on the viscosity of the bulk lubricant.

Fan et. al (J. Fan, M. Muller, T. Stohr, H. A. Spikes; Tribology Letters (2007) 28:287-298) have shown polymeric additives containing functionalized methacrylates (f-PAMAs) which have functional groups that may be able to adsorb on polar solid surfaces such as engineering steel. In their work, they used functional groups that may be clustered within the polymer molecule, for example in a block distribution, rather than in a random distributed along the polymer chain. Some of these polymers may be characterized as diblock copolymers containing the functionalized polymethacrylate block and a nonpolar block (e.g., a nonpolar tail) which may protrude from the surface being lubricated into the lubricating fluid. The film thicknesses ranged from 10 and 30 nm, increasing with the molecular weight.

Generally, the control of film thickness by increasing the polymer molecular weight may be limited by solubility as shown by S. M. Hsu*, R. S. Gates (Tribology International 38, 2005, 305-312). Poor shear stability of linear molecules, particularly under high temperature and high shear rate conditions have also been observed (see e.g., I-Chun Liou, Raymond Chien-Chao Tsiang, James Wu, Jin-Shang Liou, Hun-Chang Sheu Journal of Applied Polymer Science, Vol. 83, 2002, 1911-1918). The limit to film thickness with polymer additive adsorption and the potential inferior wear protection when the surface roughness exceeds a certain level is discussed by (R. P. Glovnea, A. V. Olver, H. A. Spikes, "Lubrication of Rough Surfaces by a Boundary Film-Forming Viscosity Modifier Additive", Journal of Tribology 2005, 127: 223-229).

The use of particles consisting of alkaline metal carbonates or hydroxides has been discussed by Bakunin et al. (V. N. Bakunin, A. Yu. Suslov, G. N. Kuzmina and O. P. Parenago A. V. Topchiev Journal of Nanoparticle Research 6: 273-284, 2004). These may be so-called overbased dispersing additives, and may improve corrosion resistance by neutralizing acids from the oxidation reactions (carboxylic acids) or sulfuric acids from fuel combustion process. Such particles containing carbonates of Alkali and Alkali earth metals are further described by Waynick (PCT Patent Application Publication Number WO 2006/119502, published Sep. 11, 2006).

Lubricating particles that have a flat planar structure, such as $MoS_2$, graphite and $WS_2$ have been used in lubricants. These particles may be stabilized as a suspension in the lubricant fluid as discussed by Coyle et al. (U.S. Pat. No. 4,995,996, issued Feb. 26, 1991, expressly incorporated herein by reference) using xanthates; Migdal et al. (U.S. Pat. No. 6,878,676, issued Apr. 12, 2005), using molybdenum sulfide particles which are capped with different non polymeric compounds such as alkyl amines, dialkyl amines, trialkyl amines, carboxylic acids; and Malshe et al. (PCT Patent Publication Number WO 2007/082299, published Jul. 19, 2007), using particles which are treated with surfactants such as lecitin, phospholipids, detergents, and sorbitan esters of fatty acids.

Colloidal suspensions having elemental metallic core particles of bismuth, tin, zinc, copper, and silver have been described by Kernizan et al. (U.S. Pat. No. 6,613,721, issued Sep. 2, 2003) where the surfactant stabilized particles may coat the surface requiring lubrication and fill in surface asperities.

Liu (PCT Patent Application Publication No. WO 2007/068102, published Jun. 21, 2007) uses organic particles stabilized by diblock or triblock copolymers. The polymer blocks provide limited attachment to a surface that is being lubricated as they contain metal binding groups that are scattered within the blocks.

FIGS. 1A and 1B illustrate features of a number of the prior art lubricant additives.

There continues to be a need for improved lubricants, such as lubricants that can contain additives that improve the performance of the lubricant. For example, there is a need for lubricants having a longer service life, e.g., when exposed to conditions of high shear, high temperature, or both. There is also a need for new lubricants and lubricant additives that reduce the wear of lubricated parts. Furthermore, there is a need for improved lubricants and lubricant additives which reduce friction (e.g., in intermediate and slow entrainment speed conditions), form a stable suspension of particles in the lubricant, form a stronger attachment to the surface being lubricated, or are more selective in locating the part that needs to be lubricated. Other attractive features desired for improved lubricants also include the ability to form a thicker lubricating layer. For example, it may be desired for a lubricant to contain an improved lubricant additives which result in a thicker lubricating layer.

There continues to be a need for lubricant additives which combine multiple features such as a combination of any two or more features for which a need was above described. For example, there is a need for lubricants additives which contain two, three or all of the features selected from the group consisting of antiwear additive, heat stabilizer additive, antioxidant, and viscosity reducer.

There is additionally a need for lubricant additives that reduce the need for or eliminates the need for expensive inorganic particle (such as extreme pressure additives), reduces the need for particles that require primer coatings, or both.

There is also a continued need for lubricant additives that have a generally stable morphology in a lubricant fluid, that can be suspended in a lubricant fluid, that do not agglomerate, or any combination thereof.

SUMMARY OF INVENTION

One or more of the above needs may be met with a capped particle comprising: (i) one or more core particles wherein the core particle is an inorganic particle having a dimension less than about 5 μm, wherein the one or more core particles includes at least one inorganic particle that is free of phosphorus, sulfur, chlorine, zinc, and nitrogen, or has a total concentration of phosphorus, sulfur, chlorine, zinc, and nitrogen less than about 10 mole %, based on the total number of moles of atoms in the inorganic particle; and (ii) one or more multi-block copolymers attached to the inorganic particles, wherein the multi-block copolymer comprises a) at least one nonpolar polymer block, b) at least one first polar polymer block, and c) at least one second polar polymer block, wherein the nonpolar polymer block is interposed between the first polar polymer block and the second polar polymer block, the first polar polymer block is attached to the core particle, and at least a portion of the second polar polymer block is not attached to the core particle; so that when used in a lubricant to lubricate a metallic surface of a workpiece, the capped particle adheres to the metallic surface of the workpiece.

One or more of the above needs may be met with a capped particle comprising: (i) one or more core particles wherein the core particle is an inorganic particle having a dimension less than about 5 μm; (ii) one or more multi-block copolymers attached to the inorganic particles, wherein the multi-block copolymer comprises a) one or more nonpolar polymer block; b) one or more first polar polymer block; and c) one or more second polar polymer block; wherein the nonpolar polymer block is interposed between the first polar polymer block and the second polar polymer block, and (iii) one or more surfactants; wherein the first polar polymer block is attached to the core particle, the surfactant forms a layer around at least a portion of the second polar polymer block.

The capped particle may be further characterized by one or any combination of the following: the first polar polymer block fully encapsulates the core particle; the surface of the inorganic particle is entirely capped by one or more of the multi-block copolymers; at least some of the second polar polymer block is not directly attached to the inorganic particle; the capped particle includes a surfactant; the inorganic particles are free of phosphorus, sulfur, chlorine, zinc, and nitrogen; the capped particle is functional in a lubricant composition and modifies or improves the lubricant composition; the inorganic particle comprises a particle that is magnetic, paramagnetic or superparamagnetic at a temperature greater than about −50° C.; the inorganic particle comprises a mixture of particle including a particle selected from the group consisting of an antioxidant, a viscosity modifier, a corrosion inhibitor, and any combination thereof; the inorganic particle comprises a particle selected from the group consisting of calcium oxide, calcium hydroxide, calcium fluoride, magnesium oxide, magnesium hydroxide, talc, iron containing metal alloys, iron containing oxides, magnetic metals, cobalt containing metal oxides, cobalt containing oxides, copper containing oxides, tin containing oxides, tin containing alloys, magnesium containing oxides, aluminum containing oxides, aluminum containing alloys, titanium containing oxides, titanium containing alloys, metallic aluminum, metallic titanium, metallic tin, metallic iron, metallic magnesium, metallic cobalt, and any combination thereof; the capped particle further comprises a second core particle wherein the second core particle includes a lubricating particle, a borate or any combination thereof; the multi-block copolymer has 3 or 4 blocks; the multi-block copolymer is attached to at least two core particles; the first polar polymer block contain one or more polar group or functional group selected from the group consisting of a carboxyl, a carbonyl, a hydroxyl, an amino, a nitrogen containing heterocyclic compound (such as a pyridyl), a sulfonyl, a sulfide, a sulfonate, a phosphate, and a phosphine; and the second polar polymer block contain one or more polar group or functional group selected from the group consisting of a carboxyl, a carbonyl, a hydroxyl, an amino, a nitrogen containing heterocyclic compound (such as a pyridyl), a sulfonyl, a sulfide, a sulfonate, a phosphate, and a phosphine; the capped particle further comprises a diblock copolymer consisting of a third polar polymer block and a second nonpolar polymer block, wherein the third polar polymer block adheres to the surface of the core particle; the inorganic particle has an average particle size from about 1 nm to about 100 μm; the nonpolar polymer block contains one or more free radically polymerizable monomers, an alkyl siloxanes, or any combination thereof; the nonpolar polymer block is soluble in oil; the nonpolar polymer block has a crystallinity of less than about 10%; the nonpolar polymer block has a weight average molecular weight of at least about 1000; the ratio of the average molecular weight of the nonpolar polymer block to the average molecular weight of the first polar polymer block is at least about 3; or the average molecular weight of the nonpolar polymer block to the average molecular weight of the second polar polymer block is at least about 3.

Another aspect of the invention a lubricant comprising a capped particle (e.g., a capped particle as taught herein) and a lubricant fluid, wherein the concentration of the capped particle is less than about 50% by weight based on the total weight of the lubricant; and the lubricant fluid is at least a theta solvent (e.g., a theta solvent at −30° C., 0° C., 20° C., 50° C., 80° C., 120° C., or even between any of these temperatures, such as from −30° C. to 120° C.) for the nonpolar polymer block.

The lubricant may be further characterized by one or any combination of the following: the lubricant fluid includes a hydrophobic base oil; the base oil has a viscosity from about 20 SUS (Saybolt Universal Seconds, measured at about 38° C.) to about 1000 SUS; or the lubricant further comprises one or more additives selected from the group consisting of dispersants, anti-foam agents, pour point depressing agents, viscosity index improving agents, rust-inhibiting agents, corrosion inhibiting agents, extreme pressure agents, and oxidation inhibiting agents.

An additional aspect of the invention is directed at a system containing a lubricant, such as a lubricant described herein (e.g., containing a lubricant containing a capped particle), wherein the system further comprises at least one lubricated work piece having a metallic surface that is lubricated by the lubricant; wherein the second polar polymer block adheres to the lubricated surface of the work piece.

The system may be further characterized by one or any combination of the following: the surface of the work piece is magnetic; the capped particle comprises a core particle which is magnetic, paramagnetic, or superparamagnetic at a temperature greater than about −50° C.; the lubricated surface has a hardness less than the hardness of the core particle of the capped particle; or the core particle of the capped particle has a hardness less than the hardness of the lubricated surface.

Yet another aspect of the invention is directed at a process for preparing a capped particle, such as a capped particle taught herein, comprising the steps of: attaching the first polar polymer block to, or polymerizing the first polar polymer block onto the inorganic particle.

This process may further be characterized by one or any combination of the following, which may be performed in any sequence: the process further comprises a step of attaching the nonpolar polymer block to, or polymerizing the nonpolar polymer block onto a polymer including the first polar polymer block, or attaching the first polar polymer block to, or polymerizing the first nonpolar polymer block onto a polymer including the nonpolar polymer block; the process further comprises a step of attaching the nonpolar polymer block to, or polymerizing the nonpolar polymer block onto a polymer including the second polar polymer block, or attaching the second polar polymer block to, or polymerizing the second polar polymer block onto a polymer including the nonpolar polymer block; the process includes one or any combination of the following steps: polymerizing the first polar polymer block, polymerizing the second polar polymer block, or polymerizing the nonpolar polymer block; the process further comprises a step of activating a nonpolar polymer block such that it becomes at least partially polar and can adhere to a surface for lubricating; or the process further comprises a step of attaching the multi-block copolymer to a second core particle.

A unique feature of the various aspects of the invention is the advantageous benefits obtained by the attraction (e.g., attachment of the second polar polymer block, attraction of a magnetic, paramagnetic or superparamagnetic particle, or both) of the capped particles to the surface of the lubricated work piece. The attraction may be at least a relatively weak attraction (e.g., the capped particles may be removed from the surface of the work piece by the thermal energy in the system), preferably the attraction is at least a relatively moderate attraction (e.g., the attachment may be permanent when the work piece is not in use, but a capped particle may be removed from a surface of the work piece when exposed to the shear forces and other forces typically generated when the work piece is in use), and more preferably the attraction is a relatively strong attraction (e.g., a permanent attachment between a capped particle and a surface of the work piece that resists the shear forces and other forces typically generated when the work piece is in use).

The capped particles of the present invention may advantageously be used to provide a layer of a lubricant fluid to a surface of a work piece (e.g., a layer greater than about 1 μm, preferably greater than about 10 μm, more preferably greater than about 30 μm, even more preferably greater than about 60 μm, and most preferably greater than about 100 μm). The attraction of the capped particles to a surface of the work piece may result in the layer of the lubricant fluid remaining on the surface even when the lubricant fluid is generally removed from the lubricated system (e.g., when the lubricant fluid leaks out of the lubricated system). As such, the capped particles may delay or prevent the wear or seizing of a lubricated system that experiences a leak.

Lubricated systems including a lubricant containing a capped particle as taught herein may have reduced wear than the same lubricant prepared without capped particle.

DETAILED DESCRIPTION

Figure 1A:
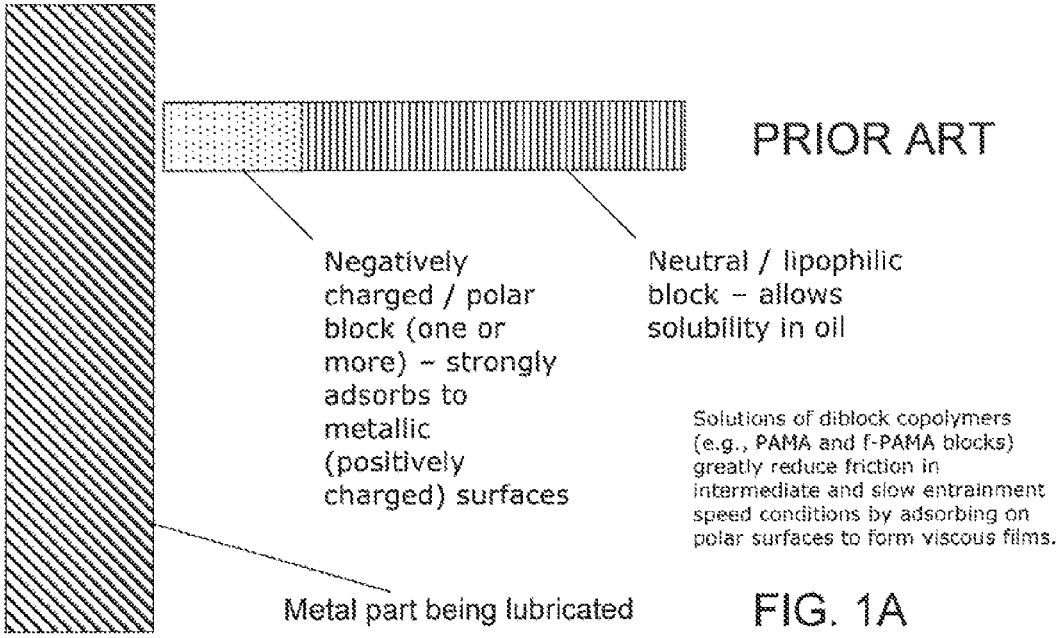
FIGS. 1A and 1B illustrate an example of a previously known diblock copolymer.
Figure 1B:
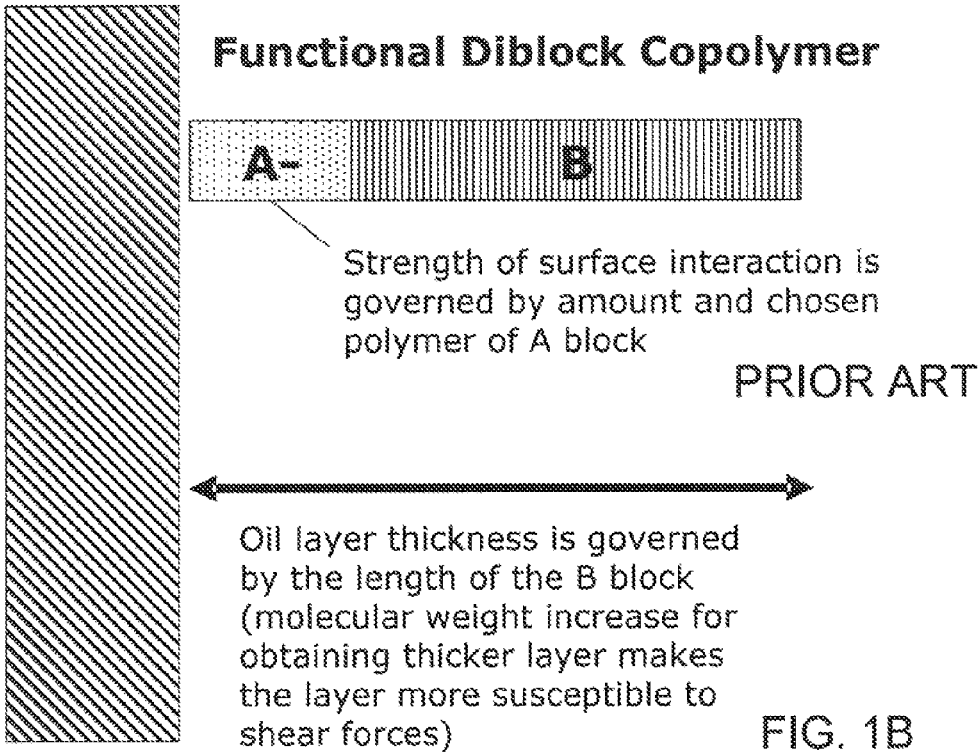

One or more of the above mentioned needs can be met by the subject of the present invention, which pertains to one or any combination of improved lubricants, additives for lubricants, method of making the additives or methods of making the lubricant. In a general sense, the present invention makes advantageous use of novel capped particles (which may be nano-sized), and more particularly a multi-block copolymer having a plurality, and more preferably at least three polymer blocks attached to a core inorganic particle (e.g., a nanoparticle). The core particle, the multi-block copolymer, or both, may impart one or more specific features which result in an improved lubricant.

In general, the compositions herein make use of a unique molecular architecture and particularly one resulting in one or any combination of the following beneficial characteristics: 1) an affinity of the additive to surfaces of a lubricated workpiece; 2) precisely tailored properties in the additives, which can be selectively varied by selection of core organic particles and polymeric blocks; 3) improvements in the shear stability and/or thermal stability of the additive, of lubricant employing the additive, or both, such that the useful life of the lubricant is increased; or 4) improved control over lubrication of articles as compared with lubricants that exclude the additives herein.

The attachment of the multi-block copolymer to the particle may be achieved by any means. For example, the multi-block copolymer may have a first polar polymer block (i.e. a polymer block that contains one or more functional polar groups) which binds (e.g., adheres) to the core particle. The binding between the first polar polymeric block and the core particle may be due to one or a combination of: van der Waals attraction, hydrogen bonding, electrostatic and dipole-dipole interaction, or covalent bonding (e.g., from a chemical reaction between a Lewis base (electron donor) and a Lewis acid (electron acceptor)). Without limitation, the attachment of the multi-block copolymer may be an attachment between a metallic core particle and the first polar polymer block.

The multi-block copolymer may also have a second polar polymeric block that is selected so that it binds (e.g., adheres) to a surface such as a surface of a part which requires lubrication. The multi-block copolymer may also contain one or more nonpolar polymeric blocks (e.g., nonpolar polymer blocks), preferably interposed between the first polar polymeric block (e.g., the first polar polymer block) and the second polar polymeric block (e.g., the second polar polymer block). The nonpolar polymeric blocks may provide some compatibility (e.g., partial compatibility or even complete compatibility) between the lubricant additive (i.e. the multi-block copolymer attached to the core particle) and the lubricant fluid. The compatibility between the nonpolar polymeric blocks and the lubricant fluid may be characterized in that the lubricant fluid may be at least a θ (theta) solvent (e.g., a theta solvent at −30° C., 0° C., 20° C., 50° C., 80° C., 120° C., or even between any of these temperatures, such as from −30° C. to 120° C.) for the nonpolar polymeric blocks (i.e., the radius of gyration of the nonpolar polymer blocks in the solvent is at least the radius of gyration of the nonpolar polymer block in the bulk amorphous state), and preferably a good solvent for the nonpolar polymeric blocks.

Accordingly, it is seen that the multi-block copolymers are designed to included at least a first functional component that binds a polymeric molecular structure to a core particle, and at least one second functional component that binds the polymeric molecular structure to a lubricated work piece.

The core particles (e.g., nanoparticles) may have a high surface energy and may therefore not form a stable suspension in a lubricant fluid. Stable suspension may be obtained by capping the core particles with the multi-block copolymers of the invention such that a polar polymer block of the copolymer binds to the core particles and a nonpolar polymer block is solvated by the lubricant fluid. A second polar polymer block that adheres to a lubricated work piece, may be designed and employed such that it will have little or no effect on the ability of the capped particle to form a stable suspension. Alternatively, a surfactant may be advantageously employed to form a stable suspension.

In its various aspects, the invention may employ materials (e.g., polymers, particles, lubricant fluids and the like), processes, and other features described in U.S. Patent Application Publication No. 2010/0004147, published on Jan. 7, 2010 by Mizrahi, incorporated herein by reference in its entirety.

The capped particles may be considered as having a layered structure. The core particle (e.g., the nanoparticle) of the capped particle may be part of a base layer (i.e., a core layer). The first polar polymer block may be a layer which is in contact with the core layer, i.e. in contact with the core particle, and binds to the core layer. The second polar polymer block may be a layer on the outside of the structure. The nonpolar polymer block (i.e., the first nonpolar polymer block) may be located in a layer that is at least partially interposed (e.g., totally interposed) between the first polar polymer block and the second polar polymer block). The structure may also have additional layers interposed between the first and second polar polymer blocks. As described herein, the layers may be complete layers or partial layers. For example, the first polar polymer block may only partially cover the core layer (as an example, the first polar polymer block may only cover one side of a plate-like core particle). In general the second polar polymer block will not be interposed between the first polar polymer block and the nonpolar polymer block. However, it is possible that the second polar polymer, block does not form a complete coating over the (first) nonpolar polymer block. Thus, at least some of the nonpolar polymer block may be interposed between the first and second polar polymer blocks. The nonpolar polymer block may provide one or any combination of the following functions: compatibilizing the core particle such that the capped particle may form a stable suspension in a lubricant fluid, maintaining a desired amount of lubricant fluid on a lubricated work piece, creating a barrier to prevent the second polar polymer block from binding to the core particle, or modifying the viscosity of the lubricant fluid. The core structure may optionally have a surfactant layer. In a particularly preferred aspect of the invention, the core particle includes a surfactant layer that partially or completely encapsulates the second polar polymer block. As such, the capped particle may be stabilized so that the second polar polymer blocks of different capped particles are prevented from forming a shared domain (e.g., a shared micelle) or otherwise becoming entangled.

Figure 2:
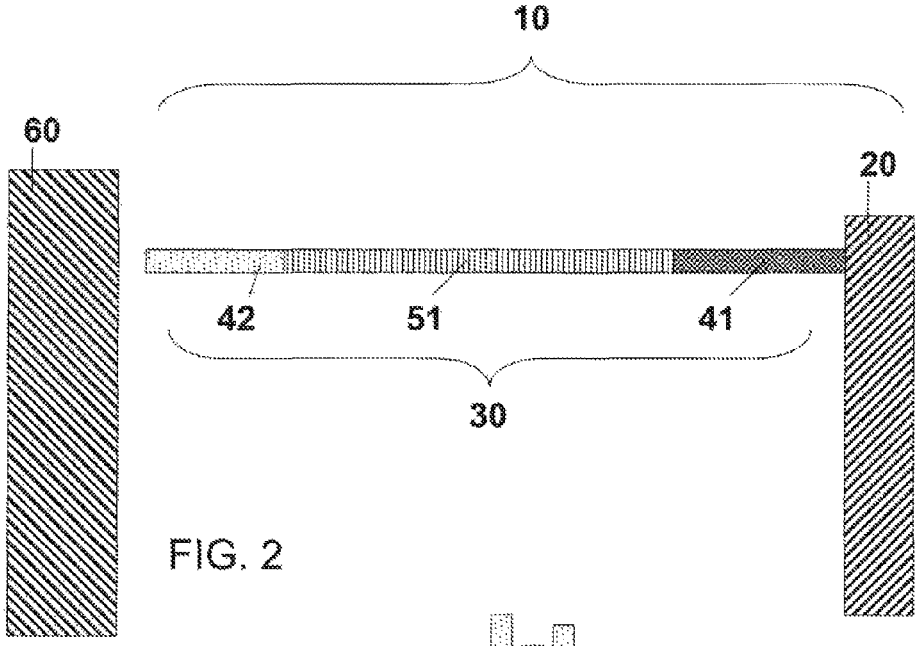
FIG. 2 illustrates an example of a capped particle according to the teachings of the present invention.

FIG. 2 schematically illustrates an example of a structural arrangement of a capped particle (e.g., a capped particle that may function as a lubricant additive) 10 of the present invention including (or even consisting essentially of) a core particle 20 (e.g., a nanoparticle core element) and a multi-block copolymer 30. The multi-block copolymer 30 may be a multi-block copolymer (i.e. a block copolymer having a plurality of, and more preferably at least three polymer blocks, at least one of which is polar and another which is nonpolar). For example, the multi-block copolymer may have a first polar polymer block 41 a second polar polymer block 42, and a first nonpolar polymer block 51. The first polar polymer block 41 caps the core particle 20 so that effectively a coating of the first polar polymer block at least partially covers (e.g., it partially or fully encapsulates) the core particle. The multi-block copolymer is thus bound to the core particle. The second polar polymer block 42 may be selected to function for binding to a surface, such as a surface of a work piece that is lubricated) 60.

Figure 3:
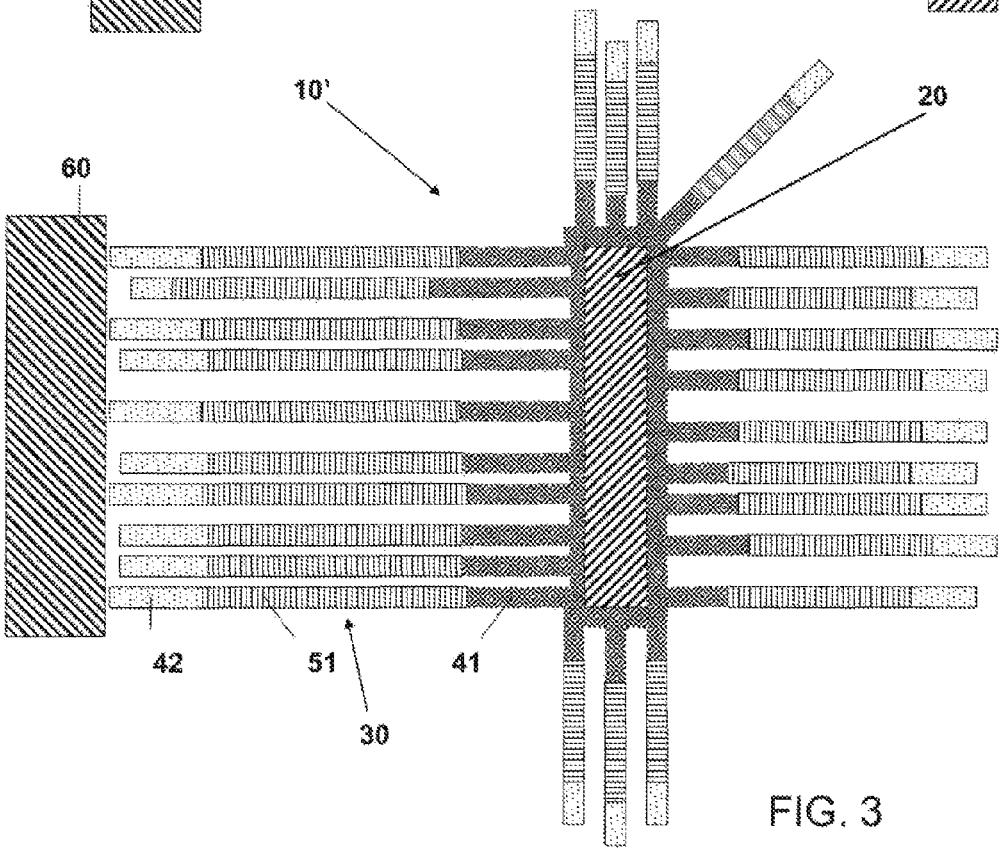
FIG. 3 illustrates an example of a capped particle having a plurality of multi-block copolymers.

FIG. 3 schematically illustrates an example of a structural arrangement of another lubricant additive 10' of the present invention. As illustrated, the lubricant additive (i.e., the capped particle) 10', may contain a plurality of multi-block copolymers 30 and the first polar polymer block 41 may completely coat the core particle 20. At least some (e.g., all) of the multi-block copolymer molecules may have a second polar polymer block 42 which may attach to the surface of a lubricated workpiece 60.

Figure 4:
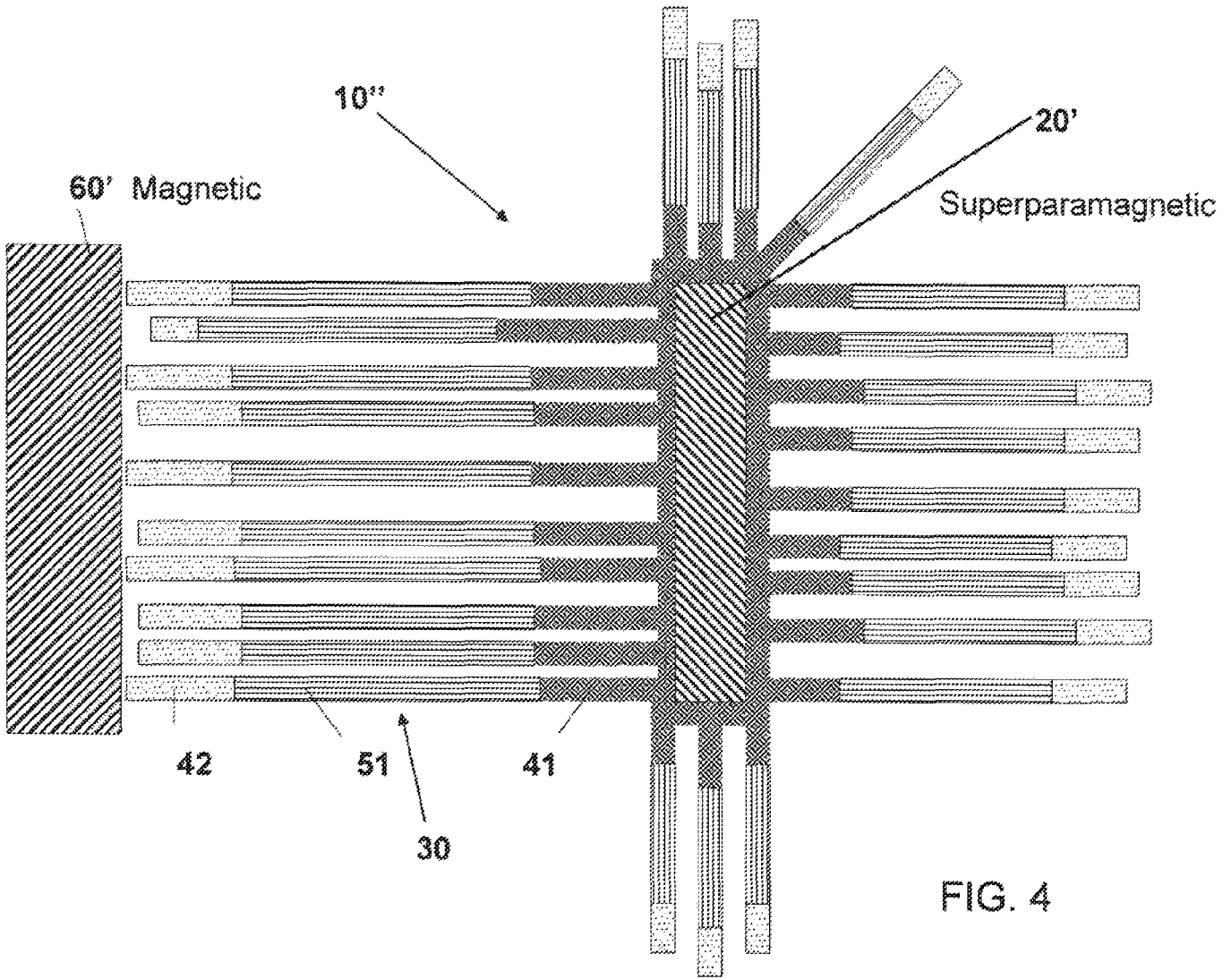
FIG. 4 illustrates an example of a capped superparamagnetic particle.

FIG. 4 schematically illustrates an example of a structural arrangement of a lubricant additive 10" of the present invention in which the core particle 20' has a property that causes attraction of the core particle to another material. For instance, it may be a magnetic particle, or even a superparamagnetic particle. Such a magnetic particle may be attracted to a metallic surface under a magnetic field. For example, a superparamagnetic particle may be attracted to a metallic surface which is magnetic 60'

Figure 5:
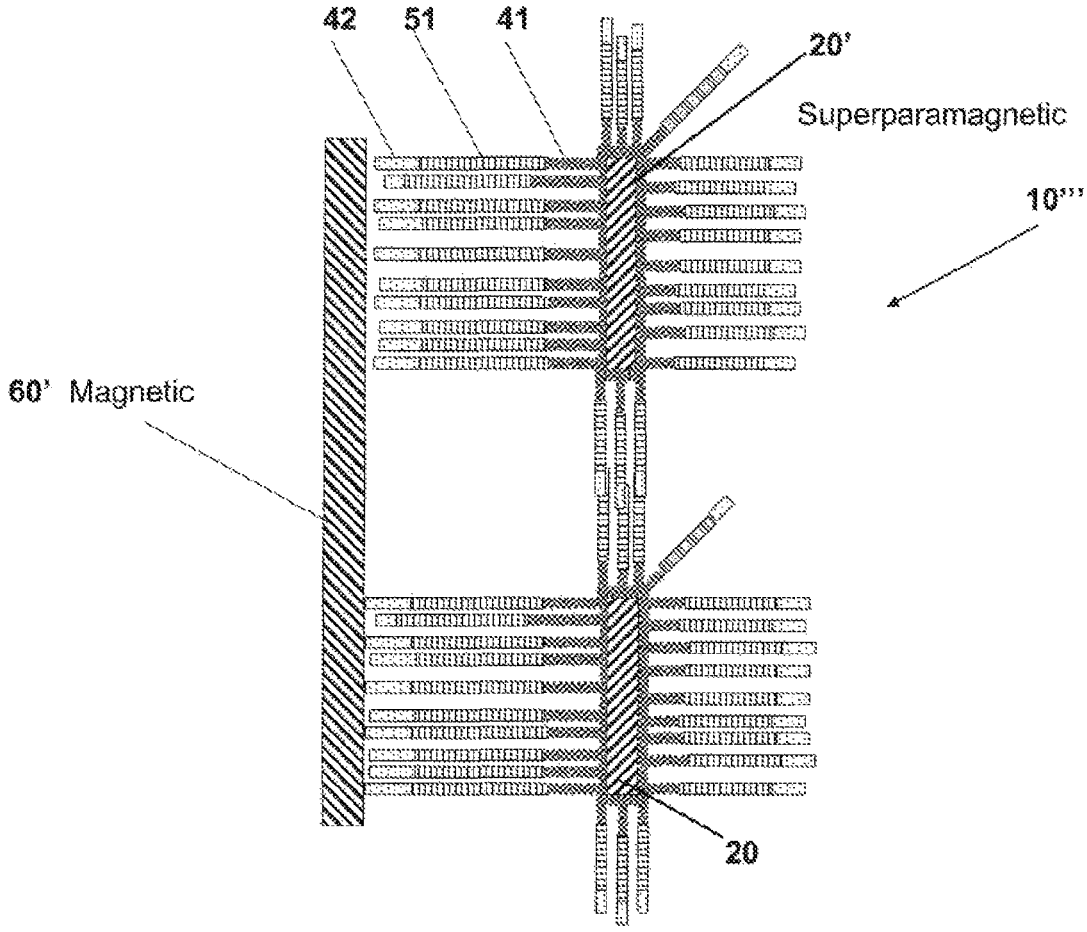
FIG. 5 illustrates an example of a capped particles containing a plurality of different particles.

FIG. 5—Illustrates a lubricant additive (e.g., a capped particle) 10''' having two different core particles 20, 20'.

Core Particles

The core particles (e.g., nanoparticles) in the present invention are preferably inorganic particles. They may be powders, flakes, whiskers, platelets, or any combination. The core particles may be generally spherical, oval shaped, elongated, flat or any other shape. Suitable core particles may have a smooth surface, a rough or irregular surface, a porous surface or any combination of such surface features. Without limitation, the core particle may include a core particle described in U.S. Patent Application Publication No. 2010/0004147, published on Jan. 7, 2010, by Mizrahi, incorporated herein by reference in its entirety.

In a particularly preferred aspect of the invention, the capped particle provides a functions that does not require art known tribologically active core particles (such as found in extreme pressure additives). As such, the capped particle preferably includes at least one particle that is not a tribologically active core particle, and more preferably, the capped particle is substantially or entirely free of tribologically active core particles. For example, the capped particle may include one or more inorganic particle that is free of phosphorus, sulfur, chlorine, zinc, and nitrogen, or has a total concentration of phosphorus, sulfur, chlorine, zinc, and nitrogen less than about 10 mole %, based on the total number of moles of atoms in the inorganic particle.

The core particles may be small and preferably have as its largest dimension, a dimension that is less than about 5 μm. Spherical core particles may be characterized by a particle dimension (i.e. particle size) equal to the diameter. Non-spherical core particles may be characterized by an equivalent diameter which is defined by the diameter of a spherical core particle having the same volume as the non-spherical core particle. In general, the core particles may have a distribution of particles sizes. The average particle size may be characterized by the volume weighted average (equivalent) diameter. The average particle size (of the core particle) may be less than about 2 μm, preferably less than about 1 μm, more preferably less than about 400 nm, and most preferably less than about 200 nm (e.g., less than about 50 nm). The average particle size may be greater than about 1 nm, preferably greater than about 4 nm, more preferably greater than about 12 nm, and most preferably greater than about 20 nm.

As indicated above, the core particles may include magnetic particles, non-magnetic particles, or both. In one aspect of the invention, at least some of the core particles are magnetic. Magnetic particles may include ferromagnetic particles, ferrimagnetic particles, paramagnetic particles, superparamagnetic particles, or any combination. Particularly useful magnetic particles include paramagnetic particles and superparamagnetic particles. Ferromagnetic particles are exemplified by particle whose magnetic spins may align spontaneously in the absence of a magnetic field. Upon heating a ferromagnetic particle, for example by heating above its Curie temperature, the ferromagnetic particle may transition to a paramagnetic particle (i.e. a particle which may have no magnetic order except in the presence of an external magnetic field). At a temperature below the Curie temperature, a particle may be superparamagnetic, meaning it may have magnetic domains whose magnetic spins are aligned within a domain, but whose domains have limited interaction and only align with each in the presence of an external magnetic field. Superparamagnetic particles may have regions whose magnetic spins self-align like a ferromagnet, but as a whole, the particles behave like a paramagnet and only have a net magnetic moment when in the presence of an external magnetic field. As such a particle may be ferromagnetic at a low temperature and may be paramagnetic at a higher temperature with a possible superparamagnetic behavior at an intermediate temperature range. For example, suitable core particles may be paramagnetic or superparamagnetic at a temperature greater than about −50° C., preferably greater than 0° C., more preferably greater than about 20° C., and most preferably greater than about 50° C. Superparamagnetic particles may also be small particles (e.g., nanoparticles) or particles having both magnetic and nonmagnetic domains such that the size of the domain of the magnetic compound is small (e.g., a diameter of less than about 500 nm, preferably less than about 100 nm, and more preferably less than about 20 nm). The magnetic susceptibility of suitable paramagnetic or superparamagnetic at 20° C. may be greater than about $5\times10^{-8}$, preferably greater less than about $1\times10^{-7}$, and most preferably greater than about $4\times10^{-5}$.

Other useful core particles in the present invention include particles which act as an antioxidant, a viscosity modifier, a corrosion inhibitor, an antiwear/extreme pressure agent, a friction modifier, an antifoam agent, a seal conditioner, a metal deactivator, and any combination thereof. Particularly useful core particles include particles which act as an antioxidant, a viscosity modifier, a corrosion inhibitor, or any combination thereof.

A plurality of different core particles may be used including a combination of a magnetic particle (e.g., a superparamagnetic particle) and a non-magnetic particle.

The core particles preferably include inorganic particles, such as metal particles, metal alloy particles, mineral particles, metal oxides, metal hydroxides, metal salts, and the like. Suitable inorganic particles include, without limitation, calcium oxide, calcium hydroxide, calcium fluoride, magnesium hydroxide, talc, iron containing metal alloys, iron containing oxides, magnetic metals, cobalt containing metal oxides, cobalt containing oxides, copper containing oxides, tin containing oxides, tin containing alloys, magnesium oxide, magnesium containing oxides, aluminum containing oxides, aluminum containing alloys, titanium containing oxides, titanium containing alloys, metallic aluminum, metallic titanium, metallic tin, metallic iron, metallic magnesium, metallic cobalt, and any combination thereof. In addition to the above mentioned particles, other metal inorganic particles which may be used (e.g., as a second or third core particle) include lubricating particles such as $MoS_2$ and $WS_2$, a borate, and any combination thereof. Another lubricating particle which may be used as a core particle is graphite.

In one aspect of the invention, two or more different core particles may be used. For example, a first lubricant additive (i.e., a first capped particle) may include a first core particle and a second lubricant additive (i.e., a second capped particle) may include a second, different core particle. In another example, a lubricant additive, may include a first core particle and a different second core particle which are connected by a multi-block copolymer.

The use of multiple core particles may impart multiple functions to the lubricant additive. For example, the lubricant additive may include two or more (e.g., two, three, four, or more) core particles, such as particles selected from the group consisting of an antioxidant, a viscosity modifier, a corrosion inhibitor, an antiwear/extreme pressure agent, a friction modifier, an antifoam agent, a seal conditioner, a metal deactivator, and any combination thereof.

The core particles may be regarded as soft (e.g., having a hardness that is lower than the surface being lubricated) such that they do not damage the surface being lubricated. For example, a core particle (or a workpiece, or a surface of a workpiece) may be characterized by a Moh's hardness (tested by indentation and comparing with the standard materials having assigned Moh's hardness values of: 1=Talc; 2=Gypsum; 3=Calcite; 4=Fluorite; 5=Apatite; 6=Orthoclase; 7=Quartz; 8=Topaz; 9=Corundum; and 10=Diamond, as described in http://www.gemcutters.org/LDA/hardness.htm as accessed on Jun. 2, 2008). The core particle may have a hardness of less than or equal to about 5 on the Moh's scale (i.e., a hardness equal to or less than calcite), preferably less than or equal to about 3 on the Moh's scale (i.e. a hardness equal to or less than apatite).

The core particles (particularly particles which are non-metallic, nonpolar, or both, such as $MoS_2$, $WS_2$, a borate, and graphite) may also be capped with a primer, a polymer, or other molecule to provide a polar surface for adhering to the multi-block copolymer.

In a particularly preferred aspect of the invention, the need for primer to coat the core particle is eliminated or reduced by employing core particles that have a polar surface. As such, at least some, substantially all, or even entirely all of the core particles may have a polar surface. For example, the capped particle may include at least one particle that is not an extreme pressure additive (e.g., at least one particle is not $MoS_2$, $WS_2$, and CdS).

Multi-Block Copolymer

The multi-block copolymer may be a linear block copolymer or may be a branched copolymer (e.g., having at least one long chain branch). The multi-block copolymer may have multiple blocks where each block contains one or more types of monomer units which are different from the polymer blocks to which they are connected. The multi-block copolymer preferably contains at least three polymer blocks (e.g., it may contain 3 polymer blocks). The multi-block copolymer may contain many blocks (particularly if it is a branched copolymer). The multi-block copolymers may contain at least 5 polymer blocks (e.g., it may contain 5 or 7 polymer blocks). For example, the multi-block copolymer may be characterized as a linear block copolymer, a block copolymer having at most about 7 polymer blocks (e.g., exactly 7 polymer blocks), or both.

Suitable multi-block copolymers include multi-block copolymers described in U.S. Patent Application Publication No. 2010/0004147, published on Jan. 7, 2010, by Mizrahi, incorporated herein by reference in its entirety.

In general, the multi-block copolymer may be characterized as a block copolymer having at least three polymer blocks. Thus, a multi-block copolymer may have three, four, five, six, seven, or more polymer blocks. The multi-block copolymer may have an even number of blocks or an odd number of blocks. The multi-block copolymer may have a plurality of polar polymer blocks and a plurality of nonpolar polymer blocks. The multi-block copolymer may have more polar polymer blocks than nonpolar polymer blocks (e.g., one more polar polymer block). The multi-block copolymer may include block copolymers having different numbers of polymer blocks (e.g., the multi-block copolymer may include a mixture of polymers having at least three polymer blocks and polymers having less than three polymer blocks. The weight fraction of polymer having at least three polymer blocks, the weight fraction of polymer having three polymer blocks, or both, may be greater than about 5 wt. %, preferably may be greater than about 15 wt %, more preferably greater than about 35 wt %, and most preferably greater than about 65 wt % (e.g., greater than about 85 wt. %) based on the total weight of the polymer in the capped particle.

The first polar polymer block, the second polar polymer block, the nonpolar polymer block, or even the entire multi-block copolymer is preferably amorphous but may have low crystallinity (e.g., less than about 10% crystallinity, less than about 5% crystallinity, or even less than about 2% crystallinity by weight of the polymer). The presence of a crystalline phase may be determined by any suitable means which are well known in the art. For example, a crystalline phase may be shown using x-ray crystallography by the presence of Bragg's diffraction of the x-rays, or using differential scanning calorimetry by the presence of a melting endotherm. The determination of the crystallinity will generally require at least one of a number of analysis which are commonly used in the field of polymer science. For example, x-ray crystallography, infrared spectroscopy, nuclear magnetic resonance (proton and/or carbon-13), and other analytical techniques may be used to identify the chemical structure (or the repeating structure) of the crystalline phase. Once the structure is identified, the theoretical heat of fusion ($H_{f,100\%}$) of a pure polymer crystal of this material may be calculated or looked up in the literature (e.g., B. Wunderlich, Macromolecular Physics, Volume 3, Crystal Melting, Academic Press, New York, 1980, or Polymer Handbook, 4th Edition, J. Brandrup, E. H. Immergut, E. A. Grulke, and Eric A. Grulke editors, and D. Bloch author, Wiley Intersciences, 1999). Having determined $H_{f,100\%}$ the percent crystallinity, $x_c$, of the multi-block copolymer may be calculated by measuring the heat of fusion of the multi-block copolymer, $H_f$, using differential scanning calorimetry and then dividing by $H_{f,100\%}$: $x_c=H_{f,100\%}/H_f$. The crystallinity may also be measured using x-ray scattering: $x_c/(1-x_c)=I_B/I_D$ where $I_B$ is the intensity of the diffracted x-rays (i.e. of the Bragg's peaks) and $I_D$ is the intensity of the diffuse scattering.

In general, the first polar polymer block, the second polar polymer block, the nonpolar polymer block, or even the entire multi-block copolymer may be substantially or entirely free of any crosslinking (i.e. upon heating the multi-block copolymer will flow under a shear stress, unlike a typical crosslinked, or thermoset, polymer which generally will not flow). The first polar polymer block, which binds to the core particle surface, may be crosslinked to advantageously improve the bond strength between the core particle and the multi-block copolymer. The nonpolar polymer block may have a small amount of crosslinking (e.g., a crosslink density less than about $5.0\times10^{-4}$ mole/ml, preferably less than about $1.0\times10^{-4}$ mole/ml, more preferably less than about $1.0\times10^{-5}$ mole/ml, and most preferably less than about $1.0\times10^{-6}$ mole/ml, based on the volume of the nonpolar polymer block, as measured for example by the C-13 NMR spectroscopy) which may advantageously increase the strength of the multi-block copolymer.

The multi-block copolymer may be a block copolymer which contains both polar and nonpolar polymer blocks. The multi-block copolymer may contains at least a first polar polymer block, a second polar polymer block and a first nonpolar polymer block. As previously stated, the first polar polymer block may be desirably selected so that it adheres to the core particles.

In one aspect of the invention, the second polar polymer block may be separated from the first polar polymer block, from the core particles, or both. E.g., the second polar polymer block may be separated from the first polar polymer block by the first nonpolar polymer block. As such, the first nonpolar polymer block interposed between the first polar polymer block and the second polar polymer block. For example, the first nonpolar polymer block may have a first end and a second end, where the first end is connected to the first polar polymer block and on the second end is connected to the second polar polymer block.

The first polar polymer block may contain one or more functional groups which may promote adhesion to the surface of the core particles. Suitable functional groups include functional groups having a dipole moment (in absolute value) greater than about 0.1 debye, preferably greater than about 0.2 debye, more preferably greater than about 0.4 debye, and most preferably greater than about 0.6 debye. For example, the first polar polymer block may contain one or more polar group or functional group selected from the group consisting of a carboxyl, a carbonyl, a hydroxyl, an amino, a nitrogen containing heterocyclic compound (such as a pyridyl), a sulfonyl, a sulfide, a sulfonate, a phosphate, and a phosphine, or any combination thereof. As another example, the first polar polymer block may contain one or more anion which reacts with the surface of core particles.

The first polar polymer block may be a homopolymer (e.g., a homopolymer of a polar monomer) or a copolymer such as a random copolymer where at least one of the monomers is a polar monomer.

The first polar polymer block may be characterized by a weight average molecular weight, a number average molecular weight, a polydispersity of the molecular weight, and the like. The first polar polymer block may have a weight average molecular weight greater than about 300 daltons, preferably greater than about 800 daltons, and most preferably greater than about 1200 daltons (e.g., greater than about 2000 daltons). The first polar polymer block may have a weight average molecular weight of less than about 150,000 daltons, preferably less than about 80,000 daltons, more preferably less than about 45,000 daltons, and most preferably less than about 25,000 daltons (e.g., less than about 15,000 daltons).

Now turning to the second polar polymer block of the (e.g., first) multi-block copolymer, one function of this block may be to adhere to a surface to be lubricated. Such adhesion may be as a result of one or more forces such as van der Waals attraction, hydrogen bonding, electrostatic and dipole-dipole interaction, or covalent bonding. This block may contain one or more polar group or functional group selected from the group consisting of a carboxyl, a carbonyl, a hydroxyl, an amino, a nitrogen containing heterocyclic compound (such as a pyridyl), a sulfonyl, a sulfide, a sulfonate, a phosphate, and a phosphine. Suitable functional groups include functional groups having a dipole moment (in absolute value) greater than about 0.1 debye, preferably greater than about 0.2 debye, more preferably greater than about 0.4 debye, and most preferably greater than about 0.6 debye. The second polar polymer block may also contains one or more anion which bonds with the surface to be lubricated.

The second polar polymer block may be a homopolymer (e.g., a homopolymer of a polar monomer) or a copolymer such as a random copolymer where at least one of the monomers is a polar monomer. The second polar polymer block may contain the same monomer composition as the first polar polymer block or it may be different.

The second polar polymer block preferably is long enough to adhere or anchor the lubricant additive to the surface to be lubricated. The second polar polymer block preferably is not so long that it will encapsulate the first nonpolar polymer block or otherwise prevent a lubricant fluid from mixing with the first nonpolar polymer block. The second polar polymer block may be characterized by a weight average molecular weight, a number average molecular weight, a polydispersity of the molecular weight, and the like. The second polar polymer block may have a weight average molecular weight greater than about 100 daltons, preferably greater than about 800 daltons, and most preferably greater than about 1200 daltons (e.g., greater than about 2000 daltons). The second polar polymer block may have a weight average molecular weight of less than about 250,000 daltons, preferably less than about 160,000 daltons, more preferably less than about 100,000 daltons, even more preferably less than about 75,000 daltons, and most preferably less than about 40,000 daltons.

The first polar polymer block, the second polar polymer block, or both may be characterized by a relatively high cohesive energy density. For example, the first polar polymer block, the second polar polymer block, or both may have a Hildebrand solubility parameter, δ, of greater than about 17.3 $MPa^{1/2}$, more preferably greater than about 18.2 $MPa^{1/2}$, and most preferably greater than about 18.9 $MPa^{1/2}$. The measurement of Hildebrand solubility parameters is well known in the art and values for many polymers are listed in Barton, AFM, Handbook of Polymer Liquid Interaction Parameters and Other Solubility Parameters. CRC Press, 1990.

The multi-block copolymer additionally contains one or more nonpolar polymer blocks (e.g., a first nonpolar polymer block) which may be attracted to the lubricant fluid. As such, the first nonpolar polymer block may have a larger radius of gyration in the lubricant fluid than absent the lubricant fluid. In a polymer solution, a theta solvent (or θ solvent) is a solvent in which polymer coils act like ideal chains, assuming exactly their random walk coil dimensions. A solvent in which polymer coils expand or swell (typically due to attractive interactions between the polymer coil and the solvent) is a good solvent for the polymer. A solvent that is a theta solvent or a good solvent to a polymer is considered to be "at least a theta solvent". The lubricant fluid may be at least a theta solvent (e.g., a theta solvent at −30° C., 0° C., 20° C., 50° C., 80° C., 120° C., or even between any of these temperatures, such as from −30° C. to 120° C.) for the first nonpolar polymer block and preferably the lubricant fluid is a good solvent for the first nonpolar polymer block. Suitable first nonpolar polymer blocks may also be soluble in a hydrocarbon oil (e.g., ASTM #2 oil), in the lubricant fluid, or both.

The nonpolar polymer block may function as a bridging portion that connects and/or separates the first and second polar polymer blocks, a polymer block that swells in the lubricant fluid, a polymer block that allows the capped particle to be suspended in the lubricant, a polymer block that modifies the viscosity of the lubricant, or any combination thereof. As such, the nonpolar polymer block may be arranged in a manner such that an expected attraction of the polar blocks is at least partially, or even substantially entirely avoided, thereby leaving at least one of the polar blocks available for attraction to a surface, such as a surface of a work piece to be lubricated. In one aspect of the invention, the function of separating the first and second polar polymer blocks includes at least partially cross-linking the nonpolar polymer block and/or encasing the first polar polymer block with the nonpolar polymer block.

The first nonpolar polymer block may be a homopolymer block containing at least about 97 wt % (e.g., about 100 wt %) of one nonpolar monomer or a copolymer block (e.g., a random copolymer block) of two or more monomers. Suitable copolymers may be free of polar monomers or may contain low concentrations of polar monomers. If present, the concentration of the polar monomers in the nonpolar polymer block is preferably less than about 10%, more preferably less than about 5%, and most preferably less than about 2% based on the total weight of the nonpolar polymer block. Suitable nonpolar monomers preferably are free of dipole moments (in absolute value) that are greater than about 0.1 debye.

The nonpolar polymer block may contain one or more monomers free radically polymerizable monomers, or alkyl siloxanes. Without limitation, free radical polymerizable monomers that may be employed include olefins, styrene, alkylstyrenes, alkyl acrylates, and alkyl methacrylates, and any combination thereof. Alkyl siloxanes, such as dimethyl siloxane, may be used in addition to or in combination with any of the forementioned monomers. Exemplary olefins may include alpha-olefins (e.g., alpha-olefins containing from 2 to about 16 carbon atoms). Preferably, one or any combination of these monomers are present in the nonpolar polymer block at a concentration greater than about 90 wt. %, preferably greater than about 95 wt. %, and most preferably greater than about 98 wt. %, based on the total weight of the nonpolar polymer block.

The nonpolar polymer block may have a weight average molecular weight of at least about 1000 daltons, preferably at least about 9000 daltons, more preferably at least about 24,000 daltons and most preferably at least about 37,000 daltons. The nonpolar polymer block may have a molecular weight less than about 200,000 daltons, preferably less than about 150,000 daltons, more preferably less than about 100,000 daltons, most preferably less than about 80,000 daltons (e.g., less than about 50,000 daltons).

The nonpolar polymer block may be characterized by a low cohesive energy density. The nonpolar polymer block has a Hildebrand solubility parameter, δ, less than the first polar polymer block, the polar polymer block, or preferably both. The nonpolar polymer block preferably has a Hildebrand solubility parameter that is at least 0.5 $MPa^{1/2}$ less than the first polar polymer block, more preferably at least 1.0 $MPa^{1/2}$ less than the first polar polymer block, even more preferably at least 2.0 $MPa^{1/2}$, less than the first polar polymer block, and most preferably at least 5.0 $MPa^{1/2}$ less than the first polar polymer block, more preferably at least 1.0 MPa. For example, the nonpolar polymer block may have a Hildebrand solubility parameter, δ, of less than about 17.2 $MPa^{1/2}$, more preferably less than about 16.9 $MPa^{1/2}$, and most preferably less than about 16.7 $MPa^{1/2}$.

The Hildebrand solubility parameter of a mixture of the one or more monomers employed to polymerize the first polar polymer block, the solubility parameter of a mixture of the one or more monomers employed to polymerize the second polar polymer block, or both, preferably is greater than the Hildebrand solubility parameter of a mixture of the one or more monomers employed to polymerize the nonpolar polymer block.

The nonpolar polymer block may be amorphous or may contains relatively low concentrations of crystalline polymer (in wt %. as measured e.g., by differential scanning calorimetry), so that the nonpolar polymer block mixes with the lubricant fluid. For example, suitable semi-crystalline compositions for the nonpolar polymer block may contain crystallinity of less than about 10% wt %, more preferably less than about 2 wt %, and most preferably less than about 0.2 wt %.

The other blocks of the multi-block copolymer (e.g., the polar polymer blocks—the first polar polymer block and the second polar polymer block) may also have low crystallinity, such that the crystallinity of the multi-block copolymer is less than about 10 wt % (more preferably less than about 2 wt %, and most preferably less than about 0.5 wt %) based on the total weight of the multi-block copolymer (or even based on the total weight of the lubricant additive).

The second polar polymer block may contain one or more original functional groups which undergo a chemical transformation (an "unveiling") that removes a part of the molecule that was chemically bonded to this group and results in a new ("unveiled") functional group which is more chemically active than the original functional group. As used herein, unveiling includes reactions that are known by the skilled artisan as unblocking reactions. Exemplary polar groups which may undergo such a chemical transformation or unveiling reaction include an ester containing original functional group which upon hydrolysis loses the alcohol ester part and forms a carboxylic acid as the new functional group. Additional examples include hydroxyl and amino new functional groups which may be generated by removing silyl derivatives.

Surfactant

The surfactant, if employed, may be any art known surfactant that is capable of forming a layer around the second polar polymer block. The surfactant preferably reduces the surface tension between the second polar polymer block and the nonpolar polymer block, between the second polar polymer block and the lubricant fluid, or both.

Figure 13:
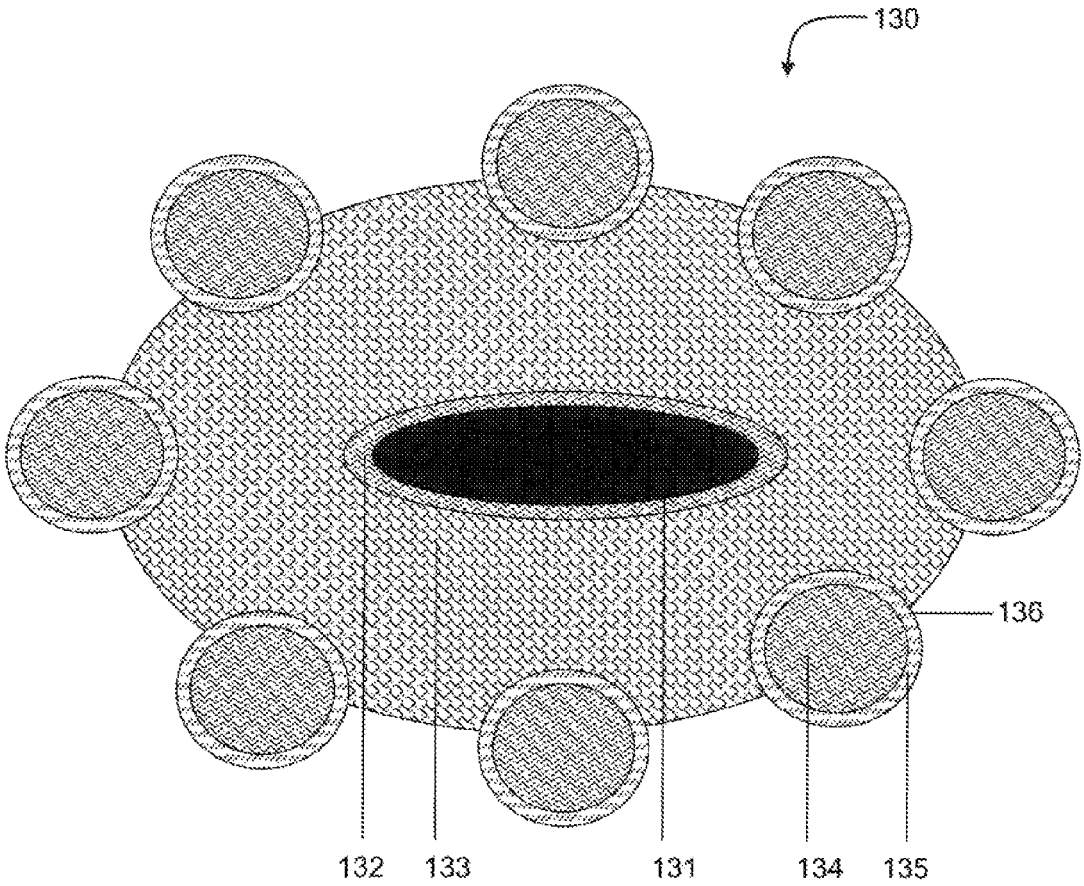
FIG. 13 illustrates an exemplary capped particle including a surfactant.

With reference to FIG. 13 the capped particle 130 including a surfactant may form a structure that includes a particle phase 131 include one or more inorganic particle. The capped particle 130 preferably has a structure including a first polar polymer phase 132 that includes the one or more first polar polymer blocks. The first polar polymer phase 132 preferably partially, or more preferably completely encapsulates the particle phase 131. The capped particle 130 preferably has a structure including a nonpolar polymer phase 133 that includes the one or more nonpolar polymer blocks. The nonpolar polymer phase 133 preferably partially or more preferably completely encapsulates the first polar polymer phase 132. The capped particle 130 preferably has a structure including a second polar polymer phase 134 that includes the one or more second polar polymer blocks. The second polar polymer phase may be a discrete phase that includes one or more domains or micelles. The first polar polymer phase 132 and the second polar polymer phase 134 are preferably separated by at least a portion of the nonpolar polymer phase 133. The capped particle 130 preferably has a structure that includes a surfactant phase 135 that includes one or more surfactants. The surfactant phase 135 preferably forms a layer that partially or completely encapsulates the second polar polymer phase 134. For example, the surfactant phase 135 may form a layer that separates the second polar polymer phase 134 and the nonpolar polymer phase 133. It will be appreciated that when the capped particle 130 is in a lubricant fluid (e.g., a lubricant fluid that swells the nonpolar polymer block), the surfactant phase 135 may form a layer that separates the second polar polymer phase 134 from the lubricant fluid.

Suitable surfactants include materials otherwise known as wetting agents, anti-foaming agents, emulsifiers, dispersing agents, leveling agents etc. Surfactants can be amphoteric surfactants, anionic surfactants, cationic surfactants, and nonionic surfactants, and many surfactants of each type are available commercially.

The surfactant preferably is a molecule that has one or more ends that is hydrophilic and one or more ends that is hydrophobic. For example, when placed on a nonpolar surface, such as a sheet of polyethylene, the surfactant preferably arranges so that the surface is preferentially contacted with the hydrophobic ends of the molecules. When placed on a high energy surface, such as a sheet of aluminum, the surface is preferentially contacted with the hydrophilic ends of the molecules. When used in the capped particle, the hydrophillic end of the surfactant preferably contacts the second polar polymer phase. The hydrophobic end of the surfactant preferably contacts the nonpolar polymer phase, the lubricant fluid, or both.

In a particularly preferred aspect of the invention, the surfactant is selected so that the surface tension of the surfactant on the metal surface to be lubricated is greater than the surface tension of the second polar polymer block on the metal surface to be lubricated. For example, the second polar polymer block may more easily wet the surface to be lubricated than does the surfactant.

The surfactant is preferably selected so that the second polar polymer phase covered by the surfactant layer is attracted to the surface of the workpiece to be lubricated (e.g., relative to the lubricant fluid, the nonpolar polymer block, or both). For example the portion of the surfactant that is not in contact with the second polar polymer block may have a dipole moment (in absolute value) greater than about 0.1 debye.

Non limiting examples of amphoteric surfactants include amine oxide surfactants, sultaine surfactants, betaine surfactants, or any combination thereof. Without limitation, exemplary amphoteric surfactants that may be employed include cocamine oxide, cocoamidopropylamine oxide, cetamine oxide, decylamine oxide, lauramine oxide, myristylamine oxide, cetyl amine oxide, steramine oxide, cocamidopropyl hydroxysultaine, sodium lauriminodipropionate, sodium cocoamphoacetate, disodium cocoamphodiacetate, disodium coamphodipropionate, capryl/capramidopropyl betaine, cocamidopropyl betaine, cetyl betaine, cocamidopropyl betaine, laurylamidopropyl betaine, or any combination thereof. Non limiting examples of anionic surfactants include lactyla surfactants, sulfate surfactants, sulfoacetate surfactants, sulfonate surfactants, sulfonic acid surfactants, sulfosuccinate surfactants, or any combination thereof. Without limitation, exemplary anionic surfactants that may be employed include sodium lauroyl lactylate, sodium stearoyl lactylate, ammonium ether sulfate, sodium tridecyl ether sulfate, sodium trideceth sulfate, ammonium nonylphenol ethoxylate sulfate, ethoxylated ammonium lauryl ether sulfate, sodium lauryl ether sulfate, ethoxylates of ammonium lauryl ether sulfate, sodium lauryl sulfate, sodium decyl sulfate, sodium nonylphenol ethoxylate sulfate, sodium octyl sulfate, ethoxylates of sodium nonylphenol ether sulfate, sodium octylphenol ethoxylate sulfate, sodium laureth sulfate, sodium lauryl ethoxy sulfate, ethoxylates of sodium laureth sulfate, ammonium laureth sulfate, alkyl phenol ether sulfate, ammonium nonyl phenol ethoxylate sulfate, sodium ether sulfate, ammonium salt of ethoxylated polyarylphenol sulfate, ammonium lauryl sulfate, sodium coco fatty alcohol sulfate, sodium coco-sulfate, sodium 2-ethyl hexyl sulfate, sodium alkyl sulfate, magnesium lauryl sulfate, monoethanol amine lauryl sulfate, ammonium alkyl ether sulfate, ammonium ether sulfate, sodium lauryl sulfoacetate, sodium methyl 2-sulfolaurate, disodium 2-sulfolaurate, sodium alphasulfo methyl c12-18 ester, disodium alphasulfo c12-18 fatty acid salt, sodium methyl-2 sulfo c12-18 ester, isopropylamine alkylbenzene sulfonate, sodium alkylbenzene sulfonate, triethanolamine-dodecylbenzene sulfonate, isopropylamine alkylbenzene sulfonate, sodium alkylbenzene sulfonate, sodium olefin sulfonate, sodium alkane sulfonate, sodium caprylyl sulfonate, isopropyl amine dodecylbenzene sulfonate, calcium alkylbenzene sulfonate, sodium dodecylbenzene sulfonate, potassium dodecylbenzene sulfonate, sodium alpha olefin sulfonate, potassium oleate sulfonate, ammonium xylene sulfonate, ammonium xylene sulfonate, morpholine p-toluene sulfonate, sodium cumene sulfonate, sodium toluene sulfonate, sxs sodium xylene sulfonate, sodium xylene sulfonate, 2-phenyl alkylbenzene sulphonic acid, alkylbenzene sulfonic acid, toluene sulphonic acid, toluene sulphonic acid monohydrate, dodecylbenzene sulfonic acid, disodium laureth sulfosuccinate, sodium lauryl sulfoacetate, sodium dioctyl sulfosuccinate, or any combination thereof. Non limiting examples of cationic surfactants include quaternary ammonium chloride surfactants, quaternary ammonium methyl sulfate surfactants, ester quaternarie surfactants, or any combination thereof. Without limitation, exemplary cationic surfactants that may be employed include cetrimonium chloride, stearalkonium chloride, olealkonium chloride, stearamidopropalkonium chloride, alkyl dimethyl benzyl ammonium chlorides, alkyl dimethyl ethylbenzyl ammonium chlorides, didecyl dimethyl ammonium chloride, dialkyl dimethyl ammonium chloride, benzalkonium chloride, methyl bis(hydrogenated tallow amidoethyl)-2-hydroxyethyl amonium methyl sulfate, methyl bis(tallowamido ethyl)-2-hydroxyethyl ammonium methyl sulfate, methyl bis (tallowamido ethyl)-2-tallow imidazolinium methyl sulfate, dialkyl ammonium methosulfate, dialkylester ammonium methosulfate, dipalmitoylethyl hydroxyethylmmonium methosulfate, dialkyl ammonium methosulfate, dialkylester ammonium methosulfate, methyl bis[ethyl (tallowate)]-2-hydroxyethyl ammonium methyl sulfate, methyl bis[ethyl (tallowate)]-2-hydroxyethyl ammonium methyl sulfate, or any combination thereof. Non limiting examples of nonionic surfactants include alkoxylate surfactants, amide surfactants, ester surfactants, ethoxylate surfactants, lactate surfactants, triglyceride surfactants, or any combination thereof. Without limitation, exemplary nonionic surfactants that may be employed include polyalkoxylated alphatic bases, polyalkoxylated amides, alkylphenol alkoxylates, alkylphenol block copolymers, alkyl phenol ethoxylates, polyalkylene oxide block copolymers, glyceryl cocoate, alcohol alkoxylates, butyl based block copolymers, polyalkylene oxide block copolymer, N, N-dimethyldecanamide (N,N-dimethylcapramide), N,N-dimethyloctanamide (N,N-dimethylcaprylamide), fatty alkanolamides, oleyl diethanolamide, lauryl diethanolamide, coco diethanolamide, fatty diethanolamides, polyethylene glycol cocamides, polyethylene glycol lauramides, lauryl monoethanolamide, myristyl monoethanolamide, coco monoisopropanolamide, alkyl ether phosphates, phosphate esters, glyceryl monostearate, glycerol monooleate, polyglyceryl decaoleates, polyglycerol esters, polyglycerol polyricinoleates, neutralized alcohol phosphates, capric triglyceride, caprylic triglyceride, tridecyl alcohol phosphate ester, nonylphenol ethoxylate phosphate ester, trimethylopropane tricaprylate tricaprate polyol ester, methyl caprylate/caprate, methyl laurate, methyl myristate, methyl palmitate, methyl oleate, alcohol phosphates, trimethylolpropane tricaprylate/caprate polyol ester, pentaerythritol tricaprylate/caprate polyol ester, pentaerythrityl tetracaprylate/tetracaprate, nonylphenol phosphate ester, phosphate esters of an alkyl polyethoxyethanol, canola oil methyl ester, soybean oil methyl ester, pentaerythritol tetracaprylate/caprate, trimethylolpropane tricaprylate/caprate, amine neutralized phosphate ester, fatty alkyl ethoxylates, alcohol ethoxylates, fatty acid ethoxylates, tallow amine ethoxylates, octyl phenol ethoxylates, nonyl phenol ethoxylate, castor oil ethoxylate, polyalkoxylated alphatic bases, polyalkoxylated amides, octyl phenol ethoxylate, tristyrylphenol ethoxylate, ammonium salt of ethoxylated polyarylphenol sulfates, tristyrylphenol ethoxylate phosphate ester, potassium salt of tristyrylphenol ethoxylate phosphate ester, ethoxylated coco amine, sorbital trioleate ethoxylate, sorbital monooleate ethoxylate, lauryl lactyl lactate, capric triglyceride, caprylic triglyceride, hydrogenated vegetable oil, or any combination thereof.

Preferred surfactants include alkyl polysaccharides, alkylamine ethoxylates, amine oxides, castor oil ethoxylates, ceto-oleyl, ceto-stearyl, decyl alcohol ethoxylates, dinonyl phenol ethoxylates, dodecyl phenol ethoxylates, end-capped ethoxylates, ethoxylated alkanolamides, ethylene glycol esters, fatty acid alkanolamides, fatty alcohol alkoxylates, lauryl, mono-branched, nonyl phenol ethoxylates, octyl phenol ethoxylates, random copolymer alkoxylates, sorbitan ester ethoxylates, stearic acid ethoxylates, synthetic, tall oil fatty acid ethoxylates, tallow amine ethoxylates, alkyl ether phosphates, alkyl phenol ether phosphates, alkyl phenol, ether sulfates, alkyl naphthalene sulfonates, condensed naphthalene sulfonates, aromatic hydrocarbon sulphonic acids, fatty alcohol sulfates, alkyl ether carboxylic acids and salts, alkyl ether sulfates, mono-alkyl sulphosuccinamates, di-alkyl sulphosuccinates, alkyl phosphates, alkyl benzene sulphonic acids and salts, alpha olefin sulfonates, condensed naphthalene sulfonates, polycarboxylates, alkyl dimethylamines, alkyl amidopropylamines, quaternised amine ethoxylates, quaternary ammonium compounds, and mixtures or combinations thereof, If employed, the amount of surfactant preferably is sufficient to form a layer that substantially encapsulates the second polar polymer phase. The surfactant may be provided before, during, or after the preparation of the capped particle. The process of preparing the multi-block copolymer may include a step of providing the surfactant. In a particularly preferred aspect of the invention, the process of preparing the multi-block copolymer includes a step of providing the surfactant during or before the polymerization off the second polar polymer block. As such, the surfactant may be employed during the polymerization of the second polar polymer block to control the size of domains or micelles containing the second polar polymer block.

Lubricant Fluid

The amount of lubricant fluid that interacts with the multi-block copolymer may be affected by the concentration of the nonpolar polymer block, the ratio of the average molecular weight of the nonpolar polymer block to the average molecular weight of the first polar polymer block, the ratio of the average molecular weight of the nonpolar polymer block to the average molecular weight of the second polar polymer block, and the like. For example, the concentration of the nonpolar polymer block may be at least 25%, preferably at least 60%, more preferably at least 75 wt % and most preferably at least 80% based on the total weight of the multi-block copolymer. The concentration of nonpolar polymer block may be less than 99.9 wt. %, preferably less than about 98 wt. %, and most preferably less than about 95 wt. % based on the total weight of the multi-block copolymer. Without limitation, the ratio of the average molecular weight of the nonpolar polymer block to the average molecular weight of the first polar polymer block may be at least about 3 (e.g., at least about 10) and/or the ratio of the average molecular weight of the nonpolar polymer block to the average molecular weight of the second polar polymer block may be at least about 3 (e.g., at least about 10). The ratio of the average molecular weight of the nonpolar block to the first polar polymer block, the ratio of the average molecular weight of the nonpolar block to the second polar polymer block, or both, may be very large, but preferably is less than about 1,000.

The capped particles of the invention may be used in a lubricant composition. The capped particles may be present in any concentration in the lubricant. For example, the capped particles may be present in a concentration greater than about 0.1 wt %, preferably greater than about 0.5 wt. %, more preferably greater than about 1.2 wt %, and most preferably greater than about 2.5 wt %, based on the total weight of the lubricant. The capped particles may be present in a concentration less than about 50 wt %, preferably less than about 40 wt %, more preferably less than about 32 wt %, and most preferably less than about 18 wt. %, based on the total weight of the lubricant.

The lubricant may contain one or more lubricant fluids or base oils. For example, the lubricant may contain a hydrophobic base oil. The base oil can be naphthenic oil, paraffinic oil, aromatic oil, or a synthetic oil such as a polyalphaolefin polyolester, diester, polyalkyl ethers, polyaryl ethers, silicone polymer fluids, or combinations thereof. The viscosity of the base oil can range from 50 to 10,000 Saybolt Universal Seconds (SUS) at about 38° C. (100° F.). In general, lubricant fluids may generally be obtainable from fossil fuels, biological materials, or any suitable feedstock.

Other hydrocarbon oils can also be used, such as one or more of: (a) oil derived from coal products, (b) alkylene polymers, such as polymers of propylene, butylene, etc., (c) olefin (alkylene) oxide-type polymers, such as olefin (alkylene) oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra (4-methyl-2-tetraethyl) silicate, hexyl(4-methol-2-pentoxy) disilicone, poly(methyl)siloxane, poly(methyl)phenylsiloxane or any combination.

The base oil may be characterized by a Saybolt viscosity (Saybolt Universal Seconds, measured at about 38° C.). The viscosity of the base oil may be greater than 10 SUS, preferably greater than about 20 SUS and more preferably greater than about 40 SUS The viscosity of the base oil may be less than about 2500 SUS, preferably less than about 1000 SUS and more preferably less than about 40 SUS.

Without limitation, the lubricant fluid may include a lubricant fluid described in U.S. Patent Application Publication No. 2010/0004147, published on Jan. 7, 2010 by Mizrahi, incorporated herein by reference in its entirety.

The capped particles preferably form a stable suspension in the lubricant fluid. For example, at least 50 wt % (preferably at least 90 wt %, and more preferably at least 98 wt %) of the lubricant additive remains in suspension after storage for 30 days (e.g., at a storage temperature of one or more of the following −30° C., at 0° C., at 25° C., or 60° C.). The concentration of suspended capped particles in the lubricant fluid may be measured e.g., by optical techniques such as by infrared spectroscopy or light scattering.

Lubricants useful in the present invention may also contain one or more additional traditional additives selected from the group consisting of dispersants, anti-foam agents, pour point depressing agents, viscosity index improving agents, rust-inhibiting agents, corrosion inhibiting agents, extreme pressure agents, oxidation inhibiting agents, or any combination thereof. The traditional additives are not core particles attached to a multi-block copolymer of the present invention.

The lubricants may be used in a system which includes one or more moving parts (i.e. work pieces) which may benefit from a lubricant to reduce frictional heat, reduce frictional force, reduce wear, or any combination thereof. For example, lubricants containing the lubricant additive may be used for lubricating a transmission system, an engine system, a bearing, or generally any abutting surfaces that require lubrication. The second polar polymer block may adhere to one or more of the surfaces which requires lubrication. Such a surface may be metallic or semi-metallic, and the like. In one aspect of the invention the surface being lubricated is a magnetic surface and the lubricant additive contains core particles which are superparamagnetic, such that the lubricant additive further adheres or is attracted to the surface by a magnetic force.

In another aspect of the invention the surface material may have a higher hardness) than the core particles in the lubricant additive (e.g., the Moh's hardness of the surface of the work piece being lubricated may be greater than the Moh's hardness of the core particles. In another aspect of the invention, the multi-block copolymer coats the core particle such that a core particle having higher Moh's hardness than the surface of the lubricated workpiece may be used.

The lubricant additive may also contain one or more additional block copolymers. For example, the lubricant may contain a diblock copolymer consisting of a third polar polymer block and a second nonpolar polymer block. The third polar polymer block may contain a functional group such that it adheres to the surface of the core particle (e.g., the third polar polymer block may contain the same functional group or groups as the first polar polymer block).

As described earlier, the nonpolar polymer block may lubricate a surface. In some aspects of the invention, it is desirable for the nonpolar polymer block when swollen by the lubricant fluid to provide a thick layer of lubricant to the surface being lubricated. For example, the swollen nonpolar polymer block may have an average thickness, $t_1$, greater than about 3 nm, preferably greater than about 10 nm, more preferably greater than about 35 nm, and most preferably greater than 120 nm (e.g., greater than about 400 nm).

The thickness of the swollen multi-block copolymer which is attached to a lubricated surface may also be characterized by the average particle separation distance, $x_1$, between the lubricated surface and the point of the core particle which is closest to the surface. The average particle separation distance may be greater than about 5 nm, preferably greater than about 15 nm, more preferably greater than about 50 nm, even more preferably greater than about 150 nm, and most preferably greater than about 500 nm. Although, the average particle separation distance, $x_1$, may be very large, it is typically less than about 0.5 mm.

The volume weighted average diameter, $d_1$, of the capped particle when swollen in the lubricant fluid may be greater than about 10 nm, preferably greater than about 100 nm, more preferably greater than about 300 nm, even more preferably greater than 900 nm, even more preferably greater than about 5,000 nm and most preferably greater than about 20,000 nm. Although, the diameter, $d_1$, of the capped particle when swollen may be very large, it is typically less than about 0.5 mm.

Without limitation, the thickness, $t_1$, the average diameter, $d_1$, and the separation distance $x_1$, may be controlled by one or more of the following: varying the number (e.g., the average number) of multi-block copolymers attached to each core particle, varying the molecular weight of the multi-block copolymer (e.g., varying the molecular weight of the first nonpolar polymer block), varying the size of the core particles, and varying the compatibility between the nonpolar polymer block and the lubricant fluid.

As previously described, the core particles in the lubricant additive may each have one or more multi-block copolymers attached. The first polar polymer block (i.e., the first polar polymer blocks of the one or more multi-block copolymers) may partially or completely coat the core particle. Preferably, the concentration of the polar polymer blocks (e.g., the first polar polymer block) is sufficient to coat at least 60% of the core particle, more preferably at least 90% of the core particle, and most preferably at least 97% of the core particle based on the total surface area of the core particle.

Lubricants comprising the capped particles may meet or exceed one or any combination of the following standards developed by the Society of Automotive Engineering: SAE J300 Grade 10W, SAE J300 Grade 15W, SAE J300 Grade 20W, SAE J300 Grade 25W, SAE J300 Grade 20, SAE J300 Grade 30, SAE J300 Grade 40, SAE J300 Grade 60, SAE J306 Grade 70W, SAE J306 Grade 85W, SAE J306 Grade 80, SAE J306 Grade 110, SAE J306 Grade 190, SAE J306 Grade 250, SAE J2363 Grade CI 4, SAE J2363 Grade CF, SAE J2363 (MIL-CID A-A-52306), or SAE J2359 (MIL-PRF-2104G).

Another aspect of the invention is a process for preparing a capped particle (e.g., a capped particle that may function as a lubricant additive) which contains a multi-block copolymer and a core particle, where the multi-block copolymer contains a first polar polymer block, a second polar polymer block, and a first nonpolar polymer block.

Capped particles (e.g., lubricant additives) of the present invention may be prepared by first polymerizing a first polar polymer block which is a homopolymer or a copolymer having at least one polar monomer such that the first polar polymer block can adhere to a core particle (e.g., a nanoparticle) and the first polar polymer block has one or more first reactive site.

This first polar polymer block is then attached to a core particle (e.g., an inorganic particle or an inorganic nanoparticle).

Next at least two additional polymer blocks are added to the molecule which contains the first polar polymer block. There are a number of possible methods for adding the additional polymer blocks.

For example, the two additional polymer blocks may be formed by polymerizing a first nonpolar polymer block onto the first reactive site, and polymerizing a second polar polymer block at the end of the nonpolar polymer block. In this method, the second polar polymer block includes at least one polar group.

Alternatively, the two additional blocks may be formed by polymerizing a first nonpolar polymer block onto the first reactive site, and polymerizing a second nonpolar polymer block at the end of the first nonpolar polymer block (or along the side of the first nonpolar polymer block). The process may include a step of activating (i.e. unveiling) the second nonpolar polymer block such that it becomes at least partially polar and can adhere to a surface for lubricating.

In another method, the two additional polymer blocks may be formed by providing a diblock copolymer which includes a first nonpolar polymer block and a second polar polymer block, and attaching the first nonpolar polymer block to the first reactive site. In this method, the second polar polymer block may include at least one polar group such that the third polymer block can adhere to a surface for lubricating;

Another method for forming the additional two block may include the steps of providing a diblock copolymer having a first nonpolar polymer block and a second nonpolar polymer block which is activatable, attaching the first nonpolar polymer block to the first reactive site, and either attaching or exposing polar groups on the second nonpolar polymer block such that it becomes at least partially polar and can adhere to a lubricated work piece.

Figure 6:
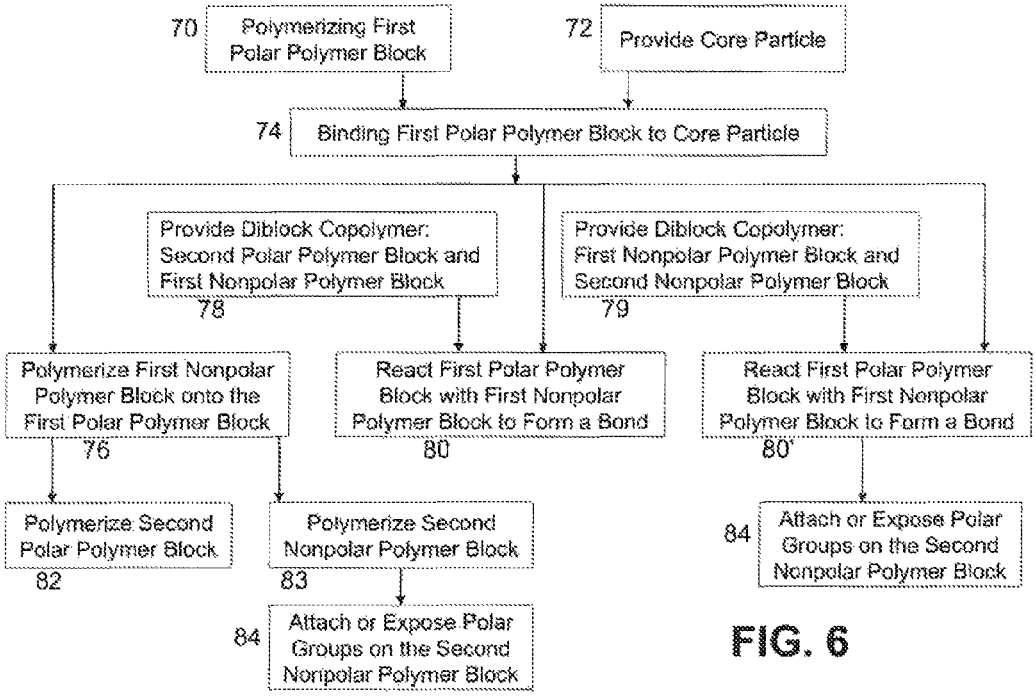
FIGS. 6-10 illustrates exemplary processes for preparing a capped particle according to the teachings herein.

An example of steps useful in this process is illustrated in FIG. 6. As illustrated in FIG. 6, this process may include steps of polymerizing a first polar polymer block 70 and providing a core particle (e.g., an inorganic particle) 72. The process may include a step of binding (e.g., adhering) 74 the first polar polymer block to the core particle. The process may include a steps of polymerizing a second polar polymer block 82 on the diblock copolymer, such that the first nonpolar polymer block is interposed between the first and second polar polymer blocks. The process may include a step of polymerizing a second nonpolar polymer block 83 on the first nonpolar polymer block such that the first nonpolar polymer block is interposed between the first polar polymer block and the second nonpolar polymer block and a step of attaching (or exposing) polar groups 84 from the second nonpolar polymer block. The process may include steps of providing a diblock copolymer having a first nonpolar polymer block and a second polar polymer block 78 and a step of reacting the first polar polymer block with the diblock copolymer 80, such that the first nonpolar polymer block is interposed between the first polar polymer block and the second polar polymer block. The process may include the steps of providing a diblock copolymer having a first nonpolar polymer block and a second nonpolar polymer block 79, a step of reacting the first polar polymer block with the diblock copolymer 80' such that the first nonpolar polymer block is interposed between the first polar polymer block and the second nonpolar polymer block, and a step of attaching (or exposing) polar groups 84 from the second nonpolar polymer block.

Another process for preparing a capped particle which may be useful as lubricant additive of the present invention includes the steps of i) providing the core particle (e.g., an inorganic particle); and ii) providing a first diblock copolymer wherein the first diblock copolymer includes a first polar polymer block and a first nonpolar polymer block. The first polar polymer block may include a homopolymer or a copolymer having at least one polar monomer such that the first polar polymer block can adheres to the core particle, and the first nonpolar polymer block may include a nonpolar homopolymer or copolymer which contains a first reactive site. The process may further include a step of iii) adsorbing the first polar polymer block onto the core particle. The process may further include a step of iv) forming a second polar polymer block. The step of forming the second polymer block may include a step of polymerizing a second polar polymer block onto the first reactive site to form a second polar polymer block having at least one polar group such that the second polar polymer block adheres to a (work piece) surface for lubricating. The step of forming the second polymer block may include a step of polymerizing a second nonpolar polymer block which is activatable onto the first reactive site, activating (i.e. unveiling) the second nonpolar polymer block such that it becomes at least partially polar and can adhere to a surface for lubricating. The step of forming the second polymer block may include a step of providing a second polar polymer block, and reacting the second polar polymer block with the first reactive site to connect the first nonpolar polymer block and the second polar polymer block where the second polar polymer block may include at least one polar group such that the second polar polymer block adheres to a surface for lubricating. The step of forming the second polymer block may include a step of providing a second diblock copolymer which comprises a second polar polymer block and a second nonpolar polymer block, wherein the second nonpolar polymer block contains a second reactive site, reacting the first reactive site with the second reactive site to form a link between the first nonpolar polymer block and the second nonpolar polymer block, where the second polar polymer block may include at least one polar group such that the second polar polymer block adheres to a surface for lubricating. The step of forming the second polymer block may include a step of providing a second diblock copolymer which comprises a second nonpolar polymer block and a third nonpolar polymer block, wherein the third nonpolar polymer block is activatable, and the second nonpolar polymer block contains a second reactive site, reacting the first reactive site with the second reactive site to form a link between the first nonpolar polymer block and the second nonpolar polymer block, activating the third nonpolar polymer block such that it becomes at least partially polar and can adhere to a surface for lubricating. The above steps (i), (ii), (iii) and (iv) may be performed in any sequence with the provision that step (iii) follow both steps (i) and (ii), and step (iv) follows step (ii). Preferably step (iv) also follows step (iii).

Figure 7:
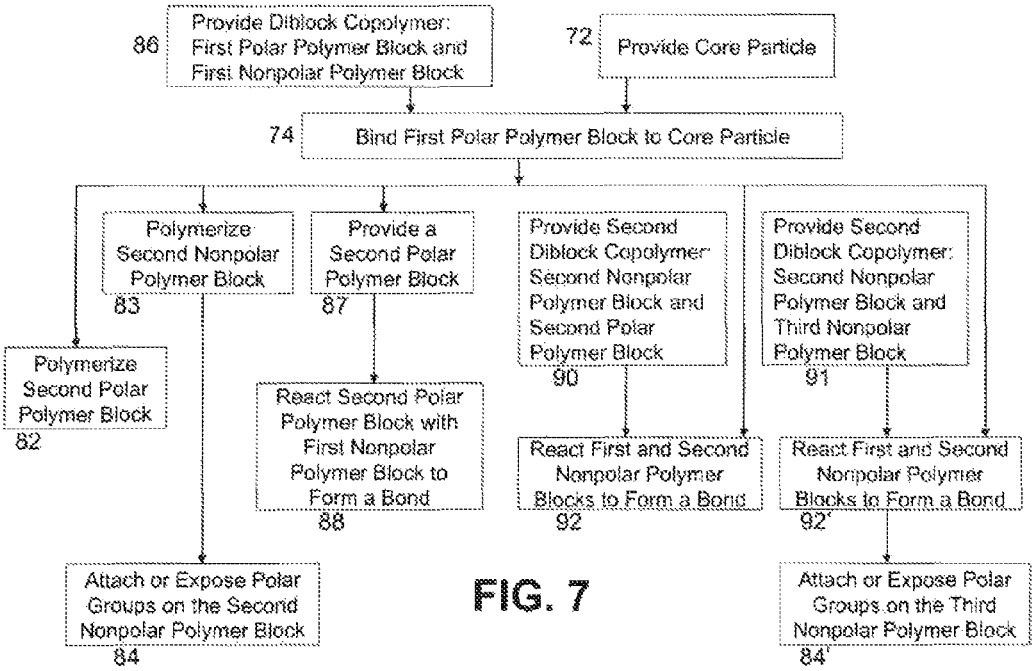

As illustrated in FIG. 7, this process may include steps of providing a diblock copolymer (e.g., a first diblock copolymer) 86 having a first polar polymer block and a first nonpolar polymer block, providing a core particle (e.g., an inorganic particle) 72, and binding (e.g., adhering) 74 the first polar polymer block to the core particle. The process may include a step of polymerizing a second polar polymer block 82 on the diblock copolymer, such that the first nonpolar polymer block is interposed between the first and second polar polymer blocks. The process may include steps of polymerizing a second nonpolar polymer block 83 on the first nonpolar polymer block such that the first nonpolar polymer block is interposed between the first polar polymer blocks and the second nonpolar polymer block and a step of attaching (or exposing) polar groups 84 from the second nonpolar polymer block. The process may include the steps of providing a second polar polymer block 87 and reacting the second polar polymer block with the first nonpolar polymer block 88 to form a covalent bond between the first nonpolar polymer block and the second polar polymer block. The process may include the steps of providing a second diblock copolymer having a second nonpolar polymer block and a second polar polymer block 90 and reacting the first and second nonpolar polymer blocks 92 to form a bond. The process may include the steps of providing second diblock copolymer having a second nonpolar polymer block and a third nonpolar polymer block 91, reacting the first and second nonpolar polymer blocks 92' to form a bond, and attaching (or exposing) polar groups 84 from the third nonpolar polymer block. The above steps are preferably performed in a sequential order, except that steps 72 and 86 may be interchanged.

Figure 8:
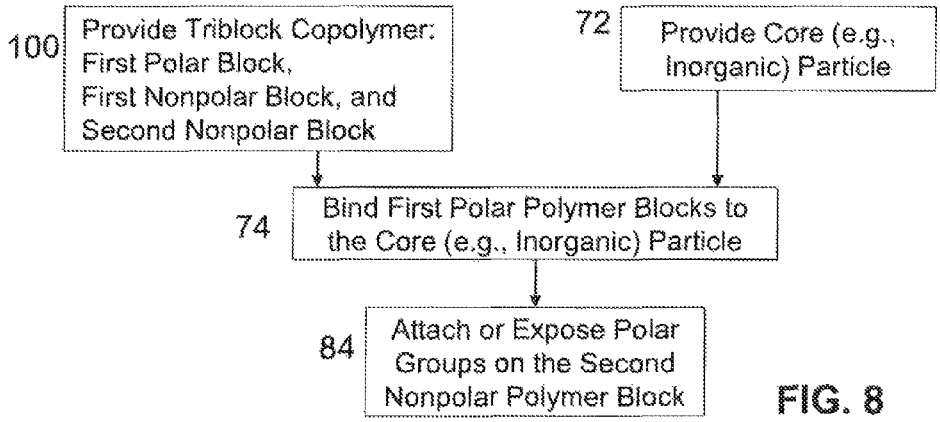

As illustrated in FIG. 8, the process for preparing the capped particle suitable for use as a lubricant additive may comprise the steps of: i) providing a first multi-block copolymer 100 wherein the first multi-block copolymer comprises a first polar polymer block, a nonpolar polymer block, and a second nonpolar polymer block wherein the second nonpolar polymer block is activatable, wherein the first polar polymer block comprises at least one polar monomer such that the first polar polymer block can adhere to an inorganic particle, ii) providing an inorganic particle 72; iii) binding (e.g., adsorbing or adhering) the first polar polymer block onto the inorganic particle 74; iv) activating the second nonpolar polymer block 84 such that it becomes at least partially polar and can adhere to a surface for lubricating; wherein the step of activating the second nonpolar polymer block includes a step of attaching or exposing polar groups.

Figure 9:
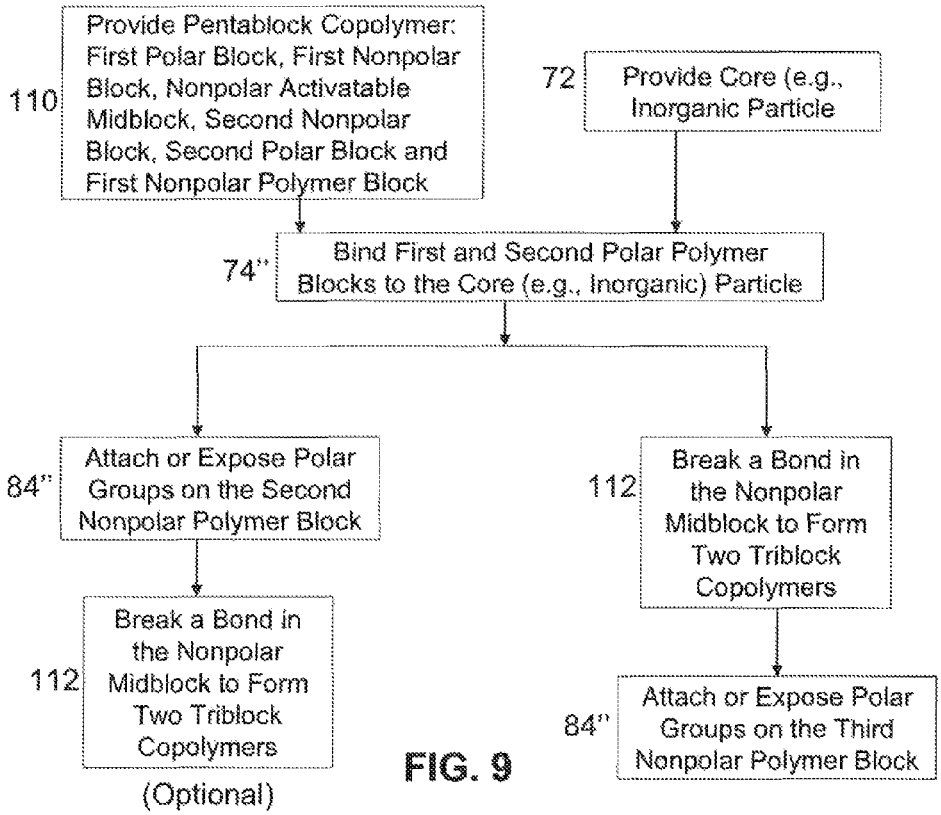

Another process for preparing capped particles is illustrated in FIG. 9, may include the steps of: i) providing a pentablock copolymer 110 comprising a first polar endblock which is connected to a first nonpolar polymer block which is connected to an intermediate block ("midblock"), which is connected to a second nonpolar polymer block, which is connected to a second polar endblock; wherein the first endblock and second endblock comprises at least one polar monomer such that the first endblock and the second endblock can adhere to an inorganic particle, wherein the midblock is a nonpolar polymer block which is activatable; ii) providing an inorganic particle 72; iii) binding (e.g., adhering, adsorbing, or otherwise attaching) the first endblock and the second endblock onto the inorganic particle 74"; and iv) activating the midblock 84" such that it becomes at least partially polar and can adhere to a lubricated surface of a work piece. The pentablock copolymer 110, as described above contains five polymer blocks. In general, a multi-block copolymer may be used having 5 or more blocks where the midblock is interposed between the first and second nonpolar polymer blocks, and the first and second nonpolar polymer blocks are interposed between the first and second polar endblocks. As such, the multi-block copolymer may also have additional blocks on the outside of the endblocks or interposed between the endblocks.

This process may further include a step of breaking a bond in the midblock 112, such that two multi-block copolymers each having at least three blocks are formed.

The step of activating midblock 84" may include a step of attaching or exposing polar groups.

The step of breaking a bond in the midblock 112 may occur prior to or subsequent to the step of activating the midblock 84".

Figure 10:
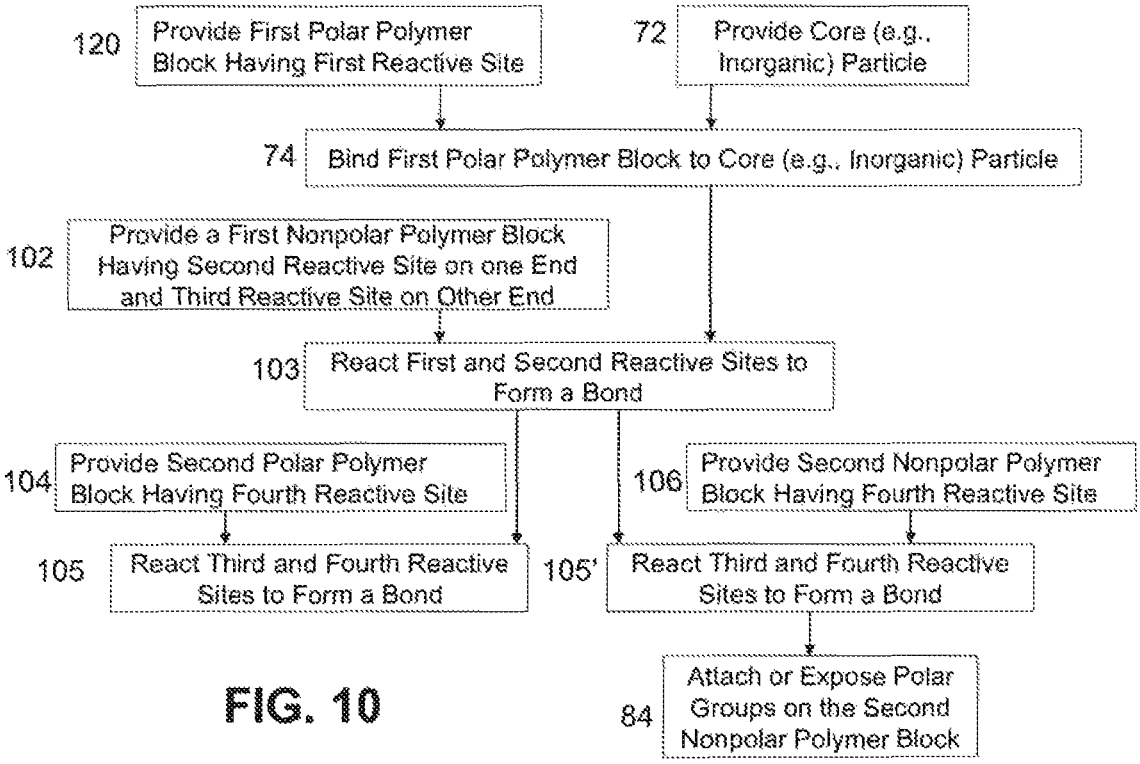

Capped particles useful in the present invention may also be prepared using steps illustrated in FIG. 10, including the steps of: i) providing a first polar polymer block 120 having a first reactive site wherein the first polar polymer block comprises a homopolymer or a copolymer having at least one polar monomer such that the first polar polymer block can adhere to an inorganic particle; ii) providing an inorganic particle 72; iii) binding the first polar polymer block to the inorganic particle 74; iv) providing a first nonpolar polymer block having a second reactive site on one end and a third reactive site on the other end 102; v) reacting the first reactive site and the second reactive site to join the first polar polymer block and the first nonpolar polymer block, thereby forming a diblock copolymer 103. The process may include additional steps vi) of either (a) providing a second polar polymer block having a fourth reactive site 104, and reacting the third reactive site and the fourth reactive site to join the nonpolar block and the second polar polymer block 105, thereby forming a triblock copolymer wherein the second polar polymer block comprises at least one polar group such that the second polar polymer block may adhere to a lubricated work piece; or (b) providing a second nonpolar polymer block having a fourth reactive site 106, wherein the second nonpolar polymer block is activatable, reacting the third reactive site and the fourth reactive site 105' to join the first nonpolar block and the second nonpolar polymer block, thereby forming a triblock copolymer, and activating the second nonpolar polymer block 84 such that it becomes at least partially polar and can adhere to a surface for lubricating.

The steps may further be characterized in that the second polar polymer block either comprises at least one polar group such that the second nonpolar polymer block adheres to a surface for lubricating or the process further comprises a step of functionalizing the second polar polymer block to form a first functionalized site that adheres to a surface for lubricating.

Figure 11:
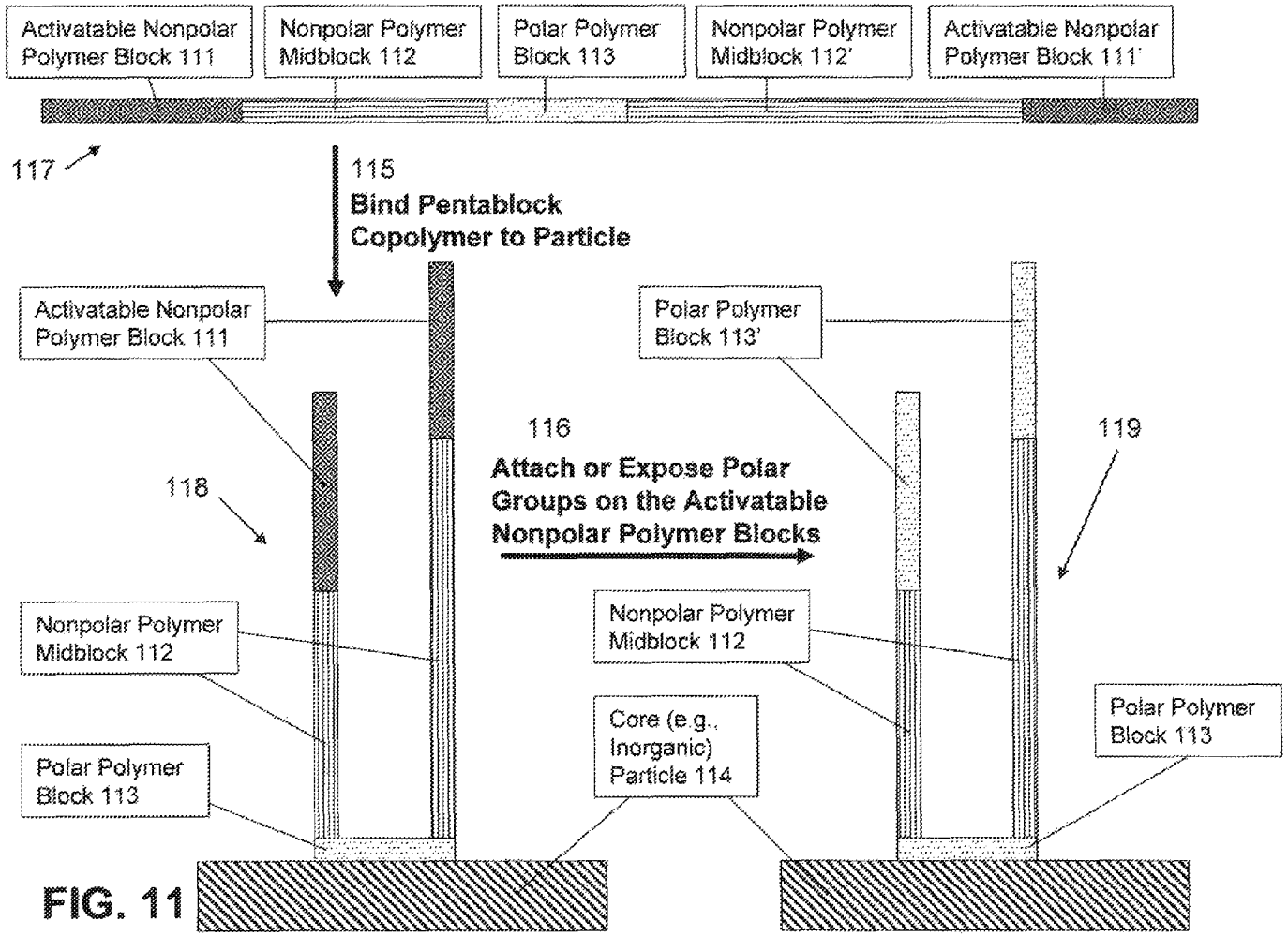
FIG. 11 illustrates an example of the attachment of a multi-block copolymer having at least five blocks to form a capped particle with two polymer appendages.

Yet another example of steps useful for preparing a capped particle is illustrated in FIG. 11. The method may include steps of: i) providing a pentablock copolymer 117 having at least five polymer blocks and two ends and comprising a first activatable nonpolar endblock 111 and a second activatable nonpolar endblock 111' positioned at opposing ends of the pentablock copolymer, a first nonpolar polymer block midblock 112 and a second nonpolar polymer midblock 112' interposed between the two end blocks 111, 111', and a first polar polymer block 113 which is interposed between the two nonpolar midblocks 112, 112' and has at least one polar monomer such that the first polar polymer block can adhere to an inorganic particle, wherein; ii) providing an inorganic particle 114; iii) binding 115 the first polar polymer block onto the inorganic particle; and iv) activating the endblocks 116 such that they becomes at least partially polar and can adhere to a surface for lubricating. FIG. 11 illustrates an example of the pentablock copolymer before being attached to the inorganic particle 117, after being attached to the inorganic particle 118, and after the endblocks have been activated 119.

Figure 12:
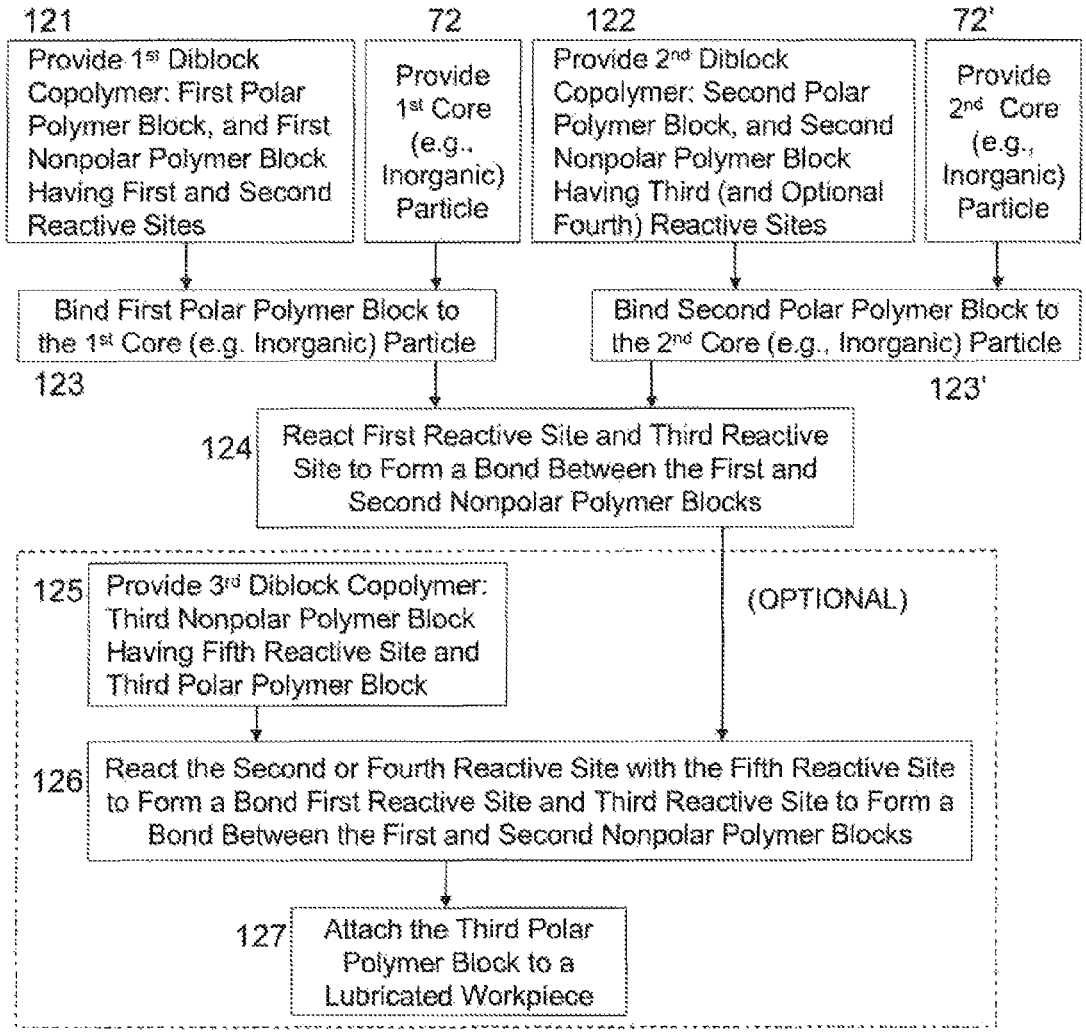
FIG. 12 illustrates an exemplary process of preparing capped particles having two particles which may be different.

It is also seen that the capped particles may contain a plurality of different core particles. Any of the previous methods for preparing capped particles may be used for preparing capped particles having different core particles. Additionally, the process may include a step of capping different core particles each with a block copolymer and then reacting the block copolymers to form a structure that contains a plurality of different core particles. For example, as illustrated in FIG. 12, an approach for preparing a capped particle containing at least two different core particles may include the steps of: (i) providing a first diblock copolymer 121 having at least one first polar polymer block and at least one first nonpolar polymer block, wherein the first nonpolar polymer block has a first reactive site and a second reactive site; (ii) providing a first inorganic particle 72; (iii) binding the first polar polymer block of the first diblock copolymer on the first inorganic particle 123; (iv) providing a second diblock copolymer 122 having at least one second polar polymer block and at least one second nonpolar polymer block, wherein the second nonpolar polymer block has a third reactive site and optionally a fourth reactive site; (v) providing a second inorganic particle 72; (vi) binding the second polar polymer block of the second diblock copolymer 123' onto the second inorganic particle; (vii) reacting the first reactive site and the third reactive site 124 to bond the first diblock copolymer and the second diblock copolymer.

This may further include the step of: (viii) providing at least one third diblock copolymer 125 having a third polar polymer block and a third nonpolar polymer block, wherein the third nonpolar polymer block comprises at least one fifth reactive site, wherein the third polar polymer block comprises at least one polar group such that the second polar polymer block adheres to a surface for lubricating. It is also possible to employ a step of reacting the fifth reactive site 126 with either the second reactive site, the fourth reactive site, or both to form a bond between the third nonpolar polymer block and at least one of the first or second nonpolar polymer blocks and a step of attaching the third polar polymer block to a lubricated work piece 127.

As used herein, unless otherwise stated, the teachings envision that any member of a genus (list) may be excluded from the genus; and/or any member of a Markush grouping may be excluded from the grouping Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps. All references herein to elements or metals belonging to a certain Group refer to the Periodic Table of the Elements published and copyrighted by CRC Press, Inc., 1989. Any reference to the Group or Groups shall be to the Group or Groups as reflected in this Periodic Table of the Elements using the IUPAC system for numbering groups.

As used herein the terms "polymer" and "polymerization" are generic, and can include either or both of the more specific cases of "homo-" and copolymer" and "homo- and copolymerization", respectively.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

What is claimed is:

1. A capped particle comprising:

(i) one or more core particles wherein the core particle is an inorganic particle having a dimension of about 5 μm or less, wherein the one or more core particles includes at least one inorganic particle that is free of phosphorus, sulfur, chlorine, zinc, and nitrogen, or has a total concentration of phosphorus, sulfur, chlorine, zinc, and nitrogen of about 10 mole % or less, based on the total number of moles of atoms in the inorganic particle; and (ii) one or more multi-block copolymers attached to the inorganic particles, wherein the multi-block copolymer comprises a) at least one nonpolar polymer block;

b) at least one first polar polymer block; and c) at least one second polar polymer block;

wherein the nonpolar polymer block is interposed between the first polar polymer block and the second polar polymer block, the first polar polymer block is attached to the core particle, and at least a portion of the second polar polymer block is not directly attached to the core particle;

so that when used in a lubricant to lubricate a metallic surface of a workpiece, the capped particle adheres to the metallic surface of the workpiece.

2. The capped particle of claim 1, wherein the first polar polymer block fully encapsulates the core particle.

3. The capped particle of claim 1, wherein the capped particle includes a surfactant.

4. The capped particle of claim 1, wherein the inorganic particle is free of phosphorus, sulfur, chlorine, zinc, and nitrogen.

5. The capped particle of claim 1, wherein the inorganic particle comprises a particle selected from the group consisting of calcium oxide, calcium hydroxide, calcium fluoride, magnesium oxide, magnesium hydroxide, talc, iron containing metal alloys, iron containing oxides, magnetic metals, cobalt containing metal oxides, cobalt containing oxides, copper containing oxides, tin containing oxides, tin containing alloys, magnesium containing oxides, aluminum containing oxides, aluminum containing alloys, titanium containing oxides, titanium containing alloys, metallic aluminum, metallic titanium, metallic tin, metallic iron, metallic magnesium, metallic cobalt, and any combination thereof.

6. The capped particle of claim 1, wherein the first polar polymer block contain one or more polar group or functional group selected from the group consisting of a carboxyl, a carbonyl, a hydroxyl, an amino, a nitrogen containing heterocyclic compound, a sulfonyl, a sulfide, a sulfonate, a phosphate, and a phosphine; and the second polar polymer block contain one or more polar group or functional group selected from the group consisting of a carboxyl, a carbonyl, a hydroxyl, an amino, a nitrogen containing heterocyclic compound, a sulfonyl, a sulfide, a sulfonate, a phosphate, and a phosphine.

7. The capped particle of claim 1, wherein-the inorganic particle is in the form of a flake, a whisker, a platelet or any combination thereof, and has an average particle size at least about 1 nm;

the nonpolar polymer block contains one or more free radically polymerizable monomers, an alkyl siloxanes, or any combination thereof;

the nonpolar polymer block is soluble in oil;

the nonpolar polymer block has a crystallinity of about 10% or less than;

the nonpolar polymer block has a weight average molecular weight of at least about 1000;

the ratio of the average molecular weight of the nonpolar polymer block to the average molecular weight of the first polar polymer block is at least about 3; and the average molecular weight of the nonpolar polymer block to the average molecular weight of the second polar polymer block is at least about 3.

8. A lubricant comprising the capped particle of claim 1; and a lubricant fluid, wherein the concentration of the capped particle is about 50% by weight or less based on the total weight of the lubricant; and the lubricant fluid is at least a theta solvent at 20° C. for the nonpolar polymer block.

9. The lubricant of claim 8, wherein the lubricant fluid includes a hydrophobic base oil, wherein the base oil has a viscosity from about 20 SUS (Saybolt Universal Seconds, measured at about 38° C.) to about 1000 SUS; and the lubricant includes one or more additives selected from the group consisting of dispersants, anti-foam agents, pour point depressing agents, viscosity index improving agents, rust-inhibiting agents, corrosion inhibiting agents, extreme pressure agents, and oxidation inhibiting agents.

10. A process for preparing the capped particle of claim 1, comprising a step of:

attaching the first polar polymer block to, or polymerizing the first polar polymer block onto the inorganic particle;

wherein the process includes one or more additional steps so that a capped particle including the multi-block copolymer attached to the inorganic core particle is formed, wherein the multi-block copolymer includes the nonpolar polymer block, the first polar polymer block, and the second polar polymer block.

11. A capped particle comprising:

(i) one or more core particles wherein the core particle is an inorganic particle having a dimension of about 5 μm or less;

(ii) one or more multi-block copolymers attached to the inorganic particles, wherein the multi-block copolymer comprises a) one or more nonpolar polymer block;

b) one or more first polar polymer block; and c) one or more second polar polymer block;

wherein the nonpolar polymer block is interposed between the first polar polymer block and the second polar polymer block, and (iii) one or more surfactants;

wherein the first polar polymer block is attached to the core particle, and the surfactant forms a layer around at least a portion of the second polar polymer block.

12. The capped particle of claim 11, wherein the inorganic particle comprises a particle selected from the group consisting of calcium oxide, calcium hydroxide, calcium fluoride, magnesium oxide, magnesium hydroxide, talc, iron containing metal alloys, iron containing oxides, magnetic metals, cobalt containing metal oxides, cobalt containing oxides, copper containing oxides, tin containing oxides, tin containing alloys, magnesium containing oxides, aluminum containing oxides, aluminum containing alloys, titanium containing oxides, titanium containing alloys, metallic aluminum, metallic titanium, metallic tin, metallic iron, metallic magnesium, metallic cobalt, and any combination thereof.

13. The capped particle of claim 11, wherein the capped particle further comprises a second core particle wherein the second core particle includes a lubricating particle, a borate or any combination thereof, and the second core particle is capped with a primer or other molecule to provide a polar surface for adhering to the multi-block copolymer.

14. The capped particle of claim 11, wherein the first polar polymer block contain one or more polar group or functional group selected from the group consisting of a carboxyl, a carbonyl, a hydroxyl, an amino, a nitrogen containing heterocyclic compound, a sulfonyl, a sulfide, a sulfonate, a phosphate, and a phosphine; and the second polar polymer block contain one or more polar group or functional group selected from the group consisting of a carboxyl, a carbonyl, a hydroxyl, an amino, a nitrogen containing heterocyclic compound, a sulfonyl, a sulfide, a sulfonate, a phosphate, and a phosphine.

15. The capped particle of claim 11, wherein the inorganic particle is in the form of a flake, a whisker, a platelet or any combination thereof, and has an average particle size at least about 1 nm;

the nonpolar polymer block contains one or more free radically polymerizable monomers, an alkyl siloxanes, or any combination thereof;

the nonpolar polymer block is soluble in oil;

the nonpolar polymer block has a crystallinity of about 10% or less;

the nonpolar polymer block has a weight average molecular weight of at least about 1000;

the ratio of the average molecular weight of the nonpolar polymer block to the average molecular weight of the first polar polymer block is at least about 3; and the average molecular weight of the nonpolar polymer block to the average molecular weight of the second polar polymer block is at least about 3.

16. The capped particle of claim 11, wherein the first polar polymer block fully encapsulates the core particle.

17. A capped particle of claim 16, wherein at least some of the second polar polymer block is not directly attached to the inorganic particle.

18. The capped particle of claim 16, wherein the inorganic particle comprises a mixture of particles including a particle selected from the group consisting of an antioxidant, a viscosity modifier, a corrosion inhibitor, and any combination thereof.

19. A lubricant comprising the capped particle of claim 16, and a lubricant fluid, wherein the concentration of the capped particle is about 50% by weight or less based on the total weight of the lubricant; and the lubricant fluid is at least a theta solvent at 20° C. for the nonpolar polymer block.

20. The lubricant of claim 19, wherein the lubricant fluid includes a hydrophobic base oil, wherein the base oil has a viscosity from about 20 SUS (Saybolt Universal Seconds, measured at about 38° C.) to about 1000 SUS; and the lubricant further comprises one or more additives selected from the group consisting of dispersants, anti-foam agents, pour point depressing agents, viscosity index improving agents, rust-inhibiting agents, corrosion inhibiting agents, extreme pressure agents, and oxidation inhibiting agents.

* * * * *